US012221763B2

(12) United States Patent
Igarashi et al.

(10) Patent No.: US 12,221,763 B2
(45) Date of Patent: Feb. 11, 2025

(54) HYDRAULIC EXCAVATOR

(71) Applicant: HITACHI CONSTRUCTION MACHINERY CO., LTD., Tokyo (JP)

(72) Inventors: Teruki Igarashi, Tsuchiura (JP); Akihiro Narazaki, Tsukuba (JP); Masamichi Itou, Toride (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 742 days.

(21) Appl. No.: 17/437,484

(22) PCT Filed: Jun. 18, 2020

(86) PCT No.: PCT/JP2020/024023
§ 371 (c)(1),
(2) Date: Sep. 9, 2021

(87) PCT Pub. No.: WO2020/262201
PCT Pub. Date: Dec. 30, 2020

(65) Prior Publication Data

US 2022/0186459 A1 Jun. 16, 2022

(30) Foreign Application Priority Data

Jun. 27, 2019 (JP) ..... 2019-120376

(51) Int. Cl.
*E02F 3/43* (2006.01)
*E02F 3/42* (2006.01)
(Continued)

(52) U.S. Cl.
CPC ..... *E02F 3/435* (2013.01); *E02F 3/425* (2013.01); *E02F 9/2228* (2013.01); *E02F 9/265* (2013.01)

(58) Field of Classification Search
CPC ... E02F 3/435; E02F 3/425; E02F 3/32; E02F 3/439; E02F 9/2228; E02F 9/2271;
(Continued)

(56) References Cited

U.S. PATENT DOCUMENTS 5,835,874 A 11/1998 Hirata et al.
6,393,838 B1 5/2002 Moriya et al.
(Continued)

FOREIGN PATENT DOCUMENTS

JP 2003-247504 A 9/2003
JP 2015-203453 A 11/2015
(Continued)

OTHER PUBLICATIONS

Extended European Search Report received in corresponding European Application No. 20830683.7 dated Jun. 6, 2023.
(Continued)

*Primary Examiner* — Thomas B Will
*Assistant Examiner* — Robert E Pezzuto
(74) *Attorney, Agent, or Firm* — MATTINGLY & MALUR, PC

(57) ABSTRACT

A hydraulic actuator includes a control valve unit that controls a flow of a hydraulic fluid supplied from a hydraulic pump to a plurality of hydraulic actuators, a plurality of control lever devices that output a pilot pressure actuating the control valve unit, with use of a discharged pressure from a pilot pump as a source pressure, a solenoid valve unit including a plurality of solenoid pressure reducing valves connected between the plurality of control lever devices and the control valve unit, and a controller configured to calculate velocity limits for the plurality of hydraulic actuators on the basis of signals from a plurality of posture sensors and control openings of the solenoid pressure reducing valves, in which the controller is configured to control the openings of
(Continued)

the solenoid pressure reducing valves for arm crowding and arm dumping to be larger than an opening based on the velocity limits while a boom raising operation signal is being output from the control lever devices.

4 Claims, 15 Drawing Sheets

(51) Int. Cl.

| | |
|---|---|
| ***E02F 9/20*** | (2006.01) |
| ***E02F 9/22*** | (2006.01) |
| ***E02F 9/26*** | (2006.01) |
| ***F15B 11/08*** | (2006.01) |

(58) Field of Classification Search
CPC ..... E02F 9/265; E02F 9/2285; E02F 9/2292; E02F 9/2296; E02F 9/2207; E02F 9/26
See application file for complete search history.

(56) References Cited

U.S. PATENT DOCUMENTS

| | | | | |
|---|---|---|---|---|
| 9,540,793 | B2 * | 1/2017 | Kami | G01C 15/00 |
| 9,551,129 | B2 * | 1/2017 | Kami | E02F 9/2285 |
| 2015/0292526 | A1 | 10/2015 | Saitoh et al. | |
| 2017/0009424 | A1 | 1/2017 | Moriki et al. | |
| 2017/0268204 | A1 | 9/2017 | Shimano et al. | |
| 2018/0002901 | A1 | 1/2018 | Shimano et al. | |
| 2019/0106861 | A1 | 4/2019 | Izumi et al. | |
| 2019/0127946 | A1 | 5/2019 | Sakai et al. | |

FOREIGN PATENT DOCUMENTS

| | | | |
|---|---|---|---|
| JP | 2016-61307 | A | 4/2016 |
| JP | 6062115 | B1 | 1/2017 |
| KR | 10-2001-0033699 | A | 4/2001 |
| WO | 95/30059 | A1 | 11/1995 |
| WO | 2018/008188 | A1 | 11/2018 |

OTHER PUBLICATIONS

Korean Office Action received in corresponding Korean Application No. 10-2021-7025262 dated Feb. 20, 2023.

International Search Report of PCT/JP2020/024023 dated Sep. 8, 2020.

International Preliminary Report on Patentability received in corresponding International Application No. PCT/JP2020/024023 dated Jan. 6, 2022.

* cited by examiner

HYDRAULIC EXCAVATOR

TECHNICAL FIELD

The present invention relates to a hydraulic excavator including a machine control function.

BACKGROUND ART

Some hydraulic excavators include a machine control (hereinafter referred to as "MC" as required) function for assisting an operator in operating a front implement. One typical example of the MC function is an area limiting control in which a boom cylinder, for example, is forcibly controlled for intervening in an operator's excavating operation, for example, to prevent a claw tip of a bucket from entering an area below an excavation target surface.

With regard to the area limiting control, Patent Document 1 discloses a system for correcting for deceleration a target velocity vector of a work implement in a direction toward an excavation target surface when the work implement approaches the excavation target surface. During the area limiting control, however, since a velocity component at which the work implement moves toward the excavation target surface is reduced as the work implement approaches the excavation target surface, the work implement is unable to perform compaction work.

On the other hand, Patent Document 2 discloses a system in which when it is determined that compacting conditions are satisfied on the basis of operator's operation, a velocity limit for a boom lowering action of a work implement in the vicinity of an excavation target surface is eased up, allowing the work implement to compact the excavation target surface even during the area limiting control.

PRIOR ART DOCUMENTS

Patent Documents

Patent Document 1: WO 95/30059 A1
Patent Document 2: JP 6062115 B1

SUMMARY OF THE INVENTION

Problems to be Solved by the Invention

The MC function is realized by reducing, with a solenoid pressure reducing valve, depending on a situation, a pilot pressure applied from a control lever device to a flow control valve that controls an action of a hydraulic actuator of a work implement such as a boom cylinder or the like. Then, according to the MC function, from the standpoint of preventing the work implement from excavating soil beyond the target excavation surface, the solenoid pressure reducing valve has its opening set to a closed side in a standby mode in order to restrain the work implement from operating abruptly. The solenoid pressure reducing valve is opened when the hydraulic actuator is allowed to operate quickly.

According to the system disclosed in Patent Document 2, when compaction work is determined, the velocity limit for the boom lowering operation is eased up. However, compaction work is not performed by only the boom lowering operation, but performed in combination with arm crowding and arm dumping actions for adjusting a compacting position. Since the arm crowding and arm dumping actions are limited in the vicinity of the surface being excavated, the adjustment operation of the compacting position is delayed, making it impossible to perform the compaction work smoothly.

It is an object of the present invention to provide a hydraulic excavator that is capable of performing work such as compaction work involving arm crowding and arm dumping actions with a good response in the vicinity of an excavation target surface even during a machine control.

Means for Solving the Problems

In order to achieve the above object, there is provided, according to the present invention, a hydraulic excavator including: a multi-joint work implement including a boom and an arm; a plurality of hydraulic actuators that actuate the work implement, the hydraulic actuators including a boom cylinder for actuating the boom; a plurality of posture sensors that detect a posture of the work implement; a hydraulic pump that discharges a hydraulic fluid actuating the plurality of hydraulic actuators; a control valve unit that controls a flow of the hydraulic fluid supplied from the hydraulic pump to the plurality of hydraulic actuators; a plurality of control lever devices that output a pilot pressure actuating the control valve unit, with use of a discharged pressure from a pilot pump as a source pressure; a solenoid valve unit including a plurality of solenoid pressure reducing valves connected between the plurality of control lever devices and the control valve unit; and a controller configured to calculate velocity limits for the plurality of hydraulic actuators on the basis of signals from the plurality of posture sensors and control openings of the solenoid pressure reducing valves to prevent the work implement from excavating soil beyond a target excavation surface on a basis of the velocity limits, in which the controller is configured to control the openings of the solenoid pressure reducing valves included in the solenoid valve unit and corresponding to arm crowding and arm dumping actions to be larger than an opening based on the velocity limits while a boom raising operation signal is being output from the control lever devices.

Advantages of the Invention

According to the present invention, it is possible to perform work such as compaction work involving arm crowding and arm dumping actions with a good response in the vicinity of an excavation target surface even during a machine control.

MODE FOR CARRYING OUT THE INVENTION

Embodiments of the present invention will be described hereinbelow with reference to the drawings.

First Embodiment

—Hydraulic Excavator—

Figure 1:
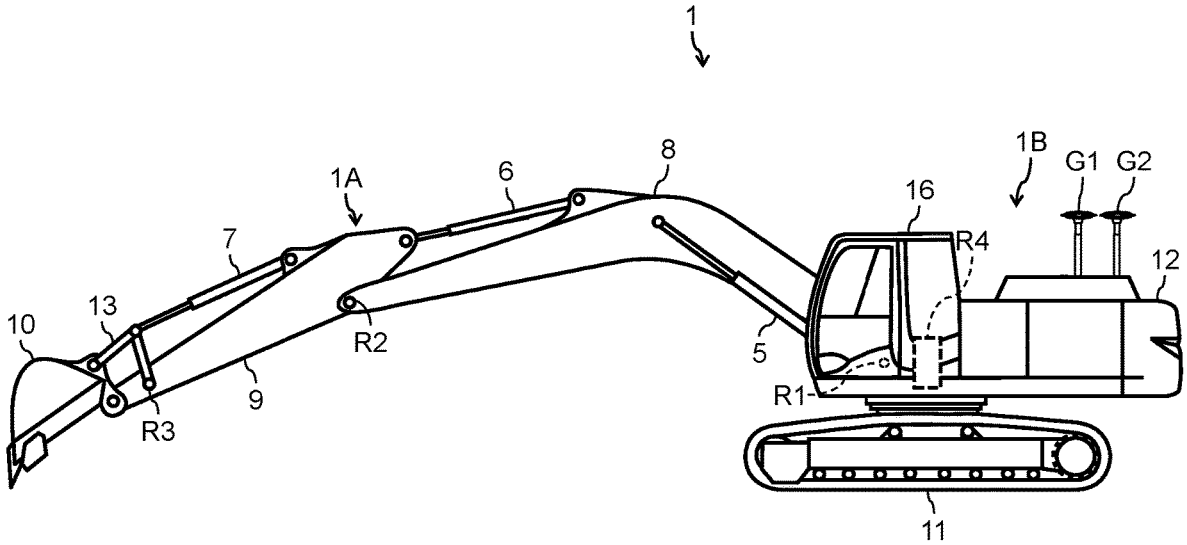
FIG. 1 is a view of a configuration of a hydraulic excavator according to a first embodiment of the present invention.

FIG. 1 is a view of a configuration of a hydraulic excavator according to a first embodiment of the present invention. Note that, according to the present embodiment, the hydraulic excavator with a bucket 10 mounted as an attachment (work tool) on a distal end of a work implement will be described by way of example below. However, the present invention is also applicable to hydraulic excavators in which other attachments than a bucket are mounted on their work implements.

Figure 2:
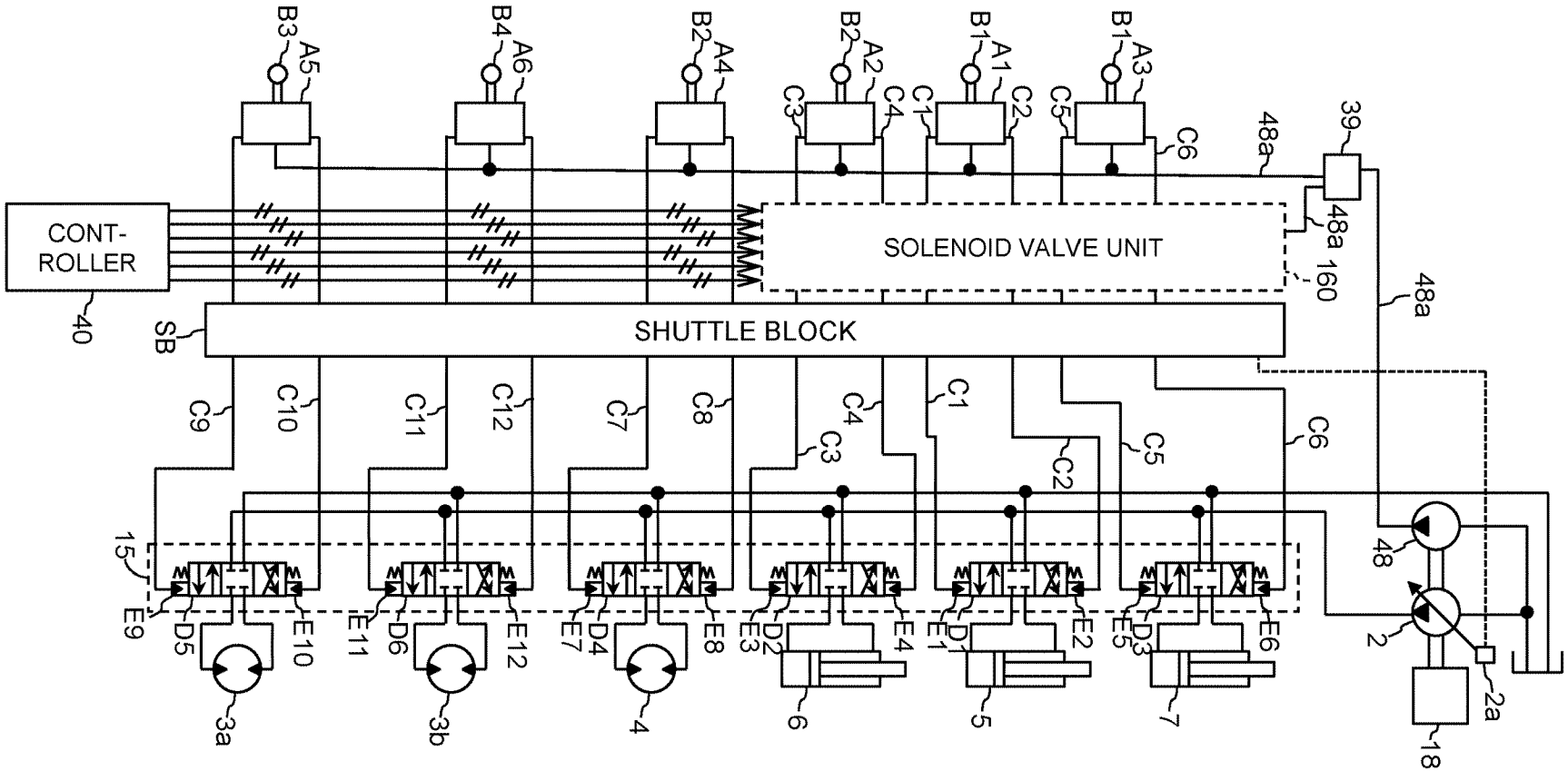
FIG. 2 is a diagram of a hydraulic circuit of a hydraulic system of the hydraulic excavator illustrated in FIG. 1.

The hydraulic excavator 1, illustrated in FIG. 1, is made up of a multi-joint work implement (front work implement) 1A and a vehicle body 1B. The vehicle body 1B includes a track structure 11 propelled by left and right track motors (hydraulic motors) 3*a* and 3*b* (FIG. 2) and a swing structure 12 mounted on the track structure 11. The swing structure 12 is swung with respect to the track structure 11 by a swing motor (hydraulic motor) 4 (FIG. 2). The swing structure 12 is swung about a central axis that extends vertically when the hydraulic excavator 1 is held at rest on a horizontal ground surface. The swing structure 12 includes an operator's cabin 16.

The work implement 1A is made up of a plurality of driven members (a boom 8, an arm 9, and a bucket 10) each angularly movable in a vertical plane, coupled together. The boom 8 has a proximal end angularly movably coupled to a front portion of the swing structure 12 by a boom pin. The arm 9 is angularly movably coupled to a distal end of the boom 8. The bucket 10 is angularly movably coupled to a distal end of the arm 9 by a bucket pin. The boom 8 is actuated by a boom cylinder 5, the arm 9 is actuated by an arm cylinder 6, and the bucket 10 is actuated by a bucket cylinder 7.

Also, an angle sensor R1 is attached to the boom pin. An angle sensor R2 is attached to the arm pin. An angle sensor R3 is attached to a bucket link 13. A vehicle body tilt angle sensor (e.g., an IMU) R4 is attached to the swing structure 12. The angle sensors R1, R2, and R3 measure respective angles $\alpha$,$\beta$, and $\gamma$ (FIG. 4) through which the boom 8, the arm 9, and the bucket 10 are angularly moved and output the measured angles $\alpha$,$\beta$, and $\gamma$ to a controller 40 (to be described later). The vehicle body tilt angle sensor R4 measures a title angle $\theta$ (FIG. 4) of the swing structure (the vehicle body 1B) with respect to a reference plane (e.g., a horizontal plane) and outputs the measured title angle $\theta$ to the controller 40 (to be described later). Note that the angle sensors R1, R2, and R3 can be replaced with sensors (IMU or the like) for measuring tilt angles with respect to respective referenced planes. In addition, the swing structure 12 has a pair of GNSS antennas G1 and G2 provided therein. The positions of reference points of the hydraulic excavator 1 and the work implement 1A in a global coordinate system can be computed on the basis of information from the GNSS antennas G1 and G2.

Note that, according to the present embodiment, the reference point of the work implement 1A will be described as being set to a bucket claw tip, by way of example. However, the reference point can be set to various points appropriately. For example, the reference point may be set to a point on a rear side surface (an outer surface) of the bucket 10 or a point on the bucket link 13 or a point on the bucket 10 that is spaced the shortest distance from a target excavation surface St (in other words, the reference point may be varied depending on a situation).

—Hydraulic System—

FIG. 2 is a diagram of a hydraulic circuit of a hydraulic system of the hydraulic excavator illustrated in FIG. 1. The operator's cabin 16 houses control lever devices A1 through A6 therein. The control lever devices A1 and A3 share a control lever B1 disposed on one of the left and right sides of an operator's seat (not shown). According to the present embodiment, when the operator operates the control lever device A1 with the control lever B1, the boom cylinder 5 (the boom 8) is actuated, and when the operator operates the control lever device A3 with the control lever B1, the bucket cylinder 7 (the bucket 10) is actuated. The control lever devices A2 and A4 share a control lever B2 disposed on the other of the left and right sides of the operator's seat. According to the present embodiment, when the operator operates the control lever device A2 with the control lever B2, the arm cylinder 6 (the arm 9) is actuated, and when the operator operates the control lever device A4 with the control lever B2, the swing motor 4 (the swing structure 12) is actuated. The control lever device A5 has a control lever B3. When the operator operates the control lever device A5 with the control lever B3, the right track motor 3*a* (the track structure 11) is actuated. The control lever device A6 has a control lever B4. When the operator operates the control lever device A6 with the control lever B4, the left track motor 3*b* (the track structure 11) is actuated. The control levers B3 and B4 are arrayed in left and right positions in front of the operator's seat.

The swing structure 12 has an engine 18 as a prime mover and also a hydraulic pump 2 and a pilot pump 48 mounted thereon. The engine 18 actuates the hydraulic pump 2 and the pilot pump 48. The hydraulic pump 2 is of variable displacement type whose displacement is controlled by a regulator 2*a*, and discharges a hydraulic fluid for actuating a plurality of hydraulic actuators (including the boom cylinder 5, the arm cylinder 6, the bucket cylinder 7 and the like). The pilot pump 48 is of fixed displacement type. In the example illustrated in FIG. 2, the regulator 2*a* is actuated by a pilot pressure applied from the control lever devices A1 through A6 via a shuttle block SB, and controls the flow rate of the hydraulic fluid discharged from the hydraulic pump 2 depending on the pilot pressure applied to the regulator 2*a*. The shuttle block SB that includes a plurality of shuttle valves is connected to pilot lines C1 through C12 that transmit pilot pressures from the control lever devices A1 through A6, and selects the maximum one of the pilot pressures from the control lever devices A1 through A6 and applies the selected pilot pressure to the regulator 2*a*.

A pump line 48*a* as a discharge conduit from the pilot pump 48 extends through a lock valve 39 and branches off into a plurality of lines that are connected to the control lever devices A1 through A6 and a solenoid valve unit 160 for machine control. The lock valve 39 according to the present embodiment is a solenoid selector valve having a solenoid electrically connected to a positional sensor of a gate lock lever (not shown) disposed in the operator's cabin 16 of the swing structure 12. The positional sensor detects the position of the gate lock lever and inputs a signal representing the detected position of the gate lock lever to the lock valve 39. When the gate lock lever is in a lock position, the lock valve 39 is closed, cutting off the pump line 48*a*. When the gate lock lever is in an unlock position, the lock valve 39 is opened, opening the pump line 48*a*. When the pump line 48*a* is in an interruption state, the control lever devices A1 through A6 are disabled, prohibiting the hydraulic excavator 1 from swinging, excavating, and making other operations.

Each of the control lever devices A1 through A6 includes a pair of pressure reducing valves of the pilot-operated type. These control lever devices A1 through A6 generate and emit pilot pressures for actuating a control valve unit 15 depending on operation amounts and directions of the control levers B1 through B4, using a discharged pressure from the pilot pump 48 as a source pressure. The control valve unit 15 includes flow control valves D1 through D6, and controls flows of the hydraulic fluid supplied from the hydraulic pump 2 to the boom cylinder 5, the arm cylinder 6, the bucket cylinder 7, the track motors 3*a* and 3*b*, and the swing motor 4. The flow control valve D1 is actuated by pilot pressures applied from the control lever device A1 through pilot lines C1 and C2 to pressure bearing chambers E1 and E2 to control the direction and flow rate of the hydraulic fluid supplied from the hydraulic pump 2 to actuate the boom cylinder 5. The flow control valve D2 is actuated by pilot pressures applied from the control lever device A2 through pilot lines C3 and C4 to pressure bearing chambers E3 and E4 to actuate the arm cylinder 6. The flow control valve D3 is actuated by pilot pressures applied from the control lever device A3 through pilot lines C5 and C6 to pressure bearing chambers E5 and E6 to actuate the bucket cylinder 7. Similarly, the flow control valves D4 through D6 are actuated by pilot pressures applied from the control lever devices A4 through A6 through pilot lines C7 through C12 to pressure bearing chambers E7 through E12 to actuate the corresponding hydraulic actuators.

—Solenoid Valve Unit—

Figure 3:
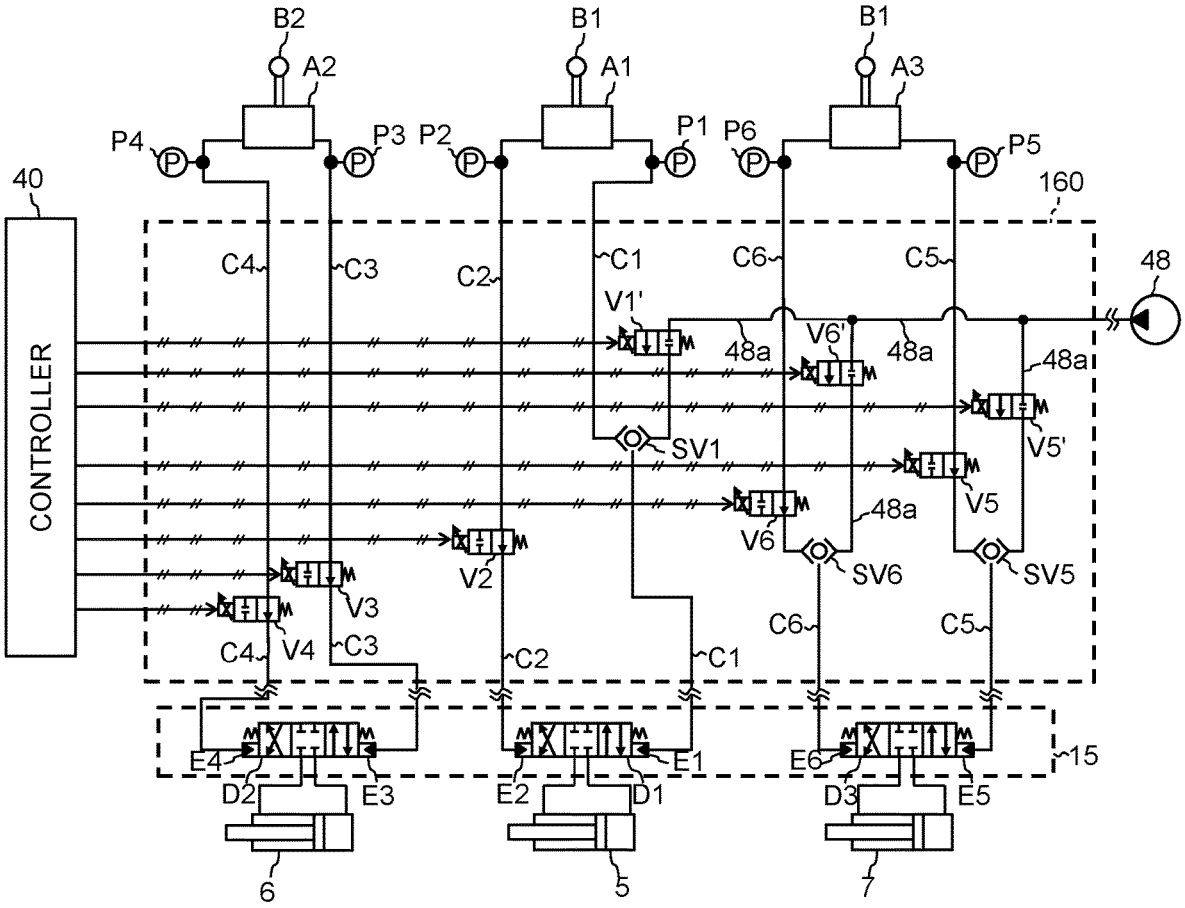
FIG. 3 is a detailed view of a solenoid valve unit of the hydraulic excavator illustrated in FIG. 1.

FIG. 3 is a detailed view of a solenoid valve unit 160 illustrated in FIG. 2. As illustrated in FIG. 3, the solenoid valve unit 160 is disposed between the plurality of control lever devices A1 through A3 and the control valve unit 15. The solenoid valve unit 160 includes solenoid pressure reducing valves V2 through V6, V1', V5', and V6', each of which is a pressure reducing valve of the solenoid proportionally driven type, and shuttle valves SV1, SV5, and SV6. Of the pilot pressures applied to the flow control valves D1 through D3, the pilot pressures emitted from the control lever devices A1 through A3 will hereinafter be referred to as "first command signals," whereas the pilot pressures emitted from the solenoid pressure reducing valves V2 through V6, V1', V5', and V6' will hereinafter be referred to as "second command signals." The second command signals include pilot pressures generated by reducing the first command signals with the solenoid pressure reducing valves V2 through V6, and pilot pressures additionally generated by reducing and correcting the discharged pressure from the pilot pump 38 with the solenoid pressure reducing valves V1', V5', and V6' in bypassing relation to the control lever devices A1 through A3. Machine control (hereinafter referred to as "MC") can be defined as control over the flow control valves D1 through D3 based on the second command signals.

The solenoid pressure reducing valve V1' has a primary port connected through the pump line 48*a* to the pilot pump 48, and reduces the discharged pressure from the pilot pump 48 and emits the reduced pressure as a pilot pressure (second command signal) for boom raising. The shuttle valve SV1 has primary ports connected respectively to the pilot line C1 for boom raising from the control lever device A1 and a secondary port of the solenoid pressure reducing valve V1', and has a secondary port connected to the pressure bearing chamber E1 of the flow control valve D1. For boom raising action, a higher one of the first command signal (boom raising operation signal) from the pilot line C1 and the second command signal from the solenoid pressure reducing valve V1' is selected by the shuttle valve SV1 and introduced into the pressure bearing chamber E1 of the flow control valve D1.

The solenoid pressure reducing valve V2 is disposed to the pilot line C2 for boom lowering action from the control lever device A1. For boom lowering action, a pilot pressure from the pilot line C1 that is reduced by the solenoid pressure reducing valve V2 as required is introduced into the pressure bearing chamber E2 of the flow control valve D1.

The solenoid pressure reducing valve V3 is disposed to the pilot line C3 for arm crowding from the control lever device A2. For arm crowding, a pilot pressure from the pilot line C3 that is reduced by the solenoid pressure reducing valve V3 as required is introduced into the pressure bearing chamber E3 of the flow control valve D2.

The solenoid pressure reducing valve V4 is disposed to the pilot line C4 for arm dumping from the control lever device A2. For arm dumping action, a pilot pressure from the pilot line C4 that is reduced by the solenoid pressure reducing valve V4 as required is introduced into the pressure bearing chamber E4 of the flow control valve D2.

The solenoid pressure reducing valve V5 is disposed to the pilot line C5 for bucket crowding from the control lever device A3. The solenoid pressure reducing valve V5' has a primary port connected through the pump line 48*a* to the pilot line 48, and reduces the discharged pressure from the pilot pump 48 and emits the reduced pressure as a pilot pressure (second command signal) for bucket crowding. The shuttle valve SV5 has primary ports connected respectively to the pilot line C5 and a secondary port of the solenoid pressure reducing valve V5', and has a secondary port connected to the pressure bearing chamber E5 of the flow control valve D3. For bucket crowding action, a higher one of the pilot pressure from the pilot line C5 and the pilot pressure from the solenoid pressure reducing valve V5' is selected by the shuttle valve SV5 and introduced into the pressure bearing chamber E5 of the flow control valve D3.

The solenoid pressure reducing valve V6 is disposed to the pilot line C6 for bucket dumping from the control lever device A3. The solenoid pressure reducing valve V6' has a primary port connected through the pump line 48*a* to the pilot line 48, and reduces the discharged pressure from the pilot pump 48 and emits the reduced pressure as a pilot pressure (second command signal) for bucket dumping. The shuttle valve SV6 has primary ports connected respectively to the pilot line C6 and a secondary port of the solenoid pressure reducing valve V6', and has a secondary port connected to the pressure bearing chamber E6 of the flow control valve D3. For an bucket dumping action, a higher one of the pilot pressure from the pilot line C6 and the pilot pressure from the solenoid pressure reducing valve V6' is selected by the shuttle valve SV6 and introduced into the pressure bearing chamber E6 of the flow control valve D3.

The solenoid pressure reducing valves V2 through V6 are of normally open type in which their openings are maximum (an open state), when their solenoid is de-energized. In proportion to an increase in command signals (electric signals) from the controller 40, their openings are reduced to a minimum opening (opening 0 according to the present embodiment). On the other hand, the solenoid pressure reducing valves V1', V5', and V6' are of normally closed type in which their openings are minimum (opening 0 according to the present embodiment) when their solenoid is de-energized. In proportion to an increase in command signals (electric signals) from the controller 40, their openings are increased to a maximum opening. When the solenoid pressure reducing valves V2 through V6 are actuated by the command signals from the controller 40, they generate pilot pressures (second command signals) by reducing and correcting the pilot pressures (first command signals) generated by the control lever devices A1 through A3. On the other hand, when the solenoid pressure reducing valves V1', V5', and V6' are actuated by the command signals from the controller 40, they generate pilot pressures (second command signals) for boom raising, bucket crowding, and bucket dumping, regardless of operation of the control lever devices A1 and A3. The second command signals represent pilot pressures controlled by the controller 40 under MC. The controller 40 thus operates the solenoid pressure reducing valves V2 through V6, V1', V5', and V6' to intervene in operator's operation under certain conditions to correct an action of the work implement 1A in order for the work implement 1A not to excavate soil beyond an excavation target surface St (FIG. 4), for example. The "excavation target surface" refers to an outer profile surface of a design terrain to be leveled by the hydraulic excavator 1 according to the present embodiment, or a surface offset by a preset distance upwardly from such an outer profile surface.

Note that the hydraulic excavator 1 includes pressure sensors P1 through P6. The pressure sensors P1 and P2 are disposed to the pilot lines C1 and C2, respectively, that interconnect the control lever device A1 and the flow control valve D1 for the boom. The pressures in the pilot lines C1 and C2, i.e., the pilot pressures (first command signals) upstream of the solenoid pressure reducing valves are detected by the pressure sensors P1 and P2, respectively, as operation amounts of the boom brought about by the control lever B1. The pressure sensors P3 and P4 are disposed to the pilot lines C3 and C4, respectively, that interconnect the control lever device A2 and the flow control valve D2 for the arm. The pressures in the pilot lines C3 and C4, i.e., the pilot pressures (first command signals) upstream of the solenoid pressure reducing valves V3 and V4 are detected by the pressure sensors P3 and P4, respectively, as operation amounts of the arm brought about by the control lever B2. The pressure sensors P5 and P6 are disposed to the pilot lines C5 and C6, respectively, that interconnect the control lever device A3 and the flow control valve D3 for the bucket. The pressures in the pilot lines C5 and C6, i.e., the pilot pressures (first command signals) upstream of the solenoid pressure reducing valves V5 and V6 are detected by the pressure sensors P5 and P6, respectively, as operation amounts of the bucket brought about by the control lever B1. Detected signals from the pressure sensors P1 through P6 are input to the controller 40. Lines interconnecting the pressure sensors P1 through P6 and the controller 40 are omitted from illustration.

—Method of Calculating Bucket Claw Tip Position (Work Implement Reference Point)—

Figure 4:
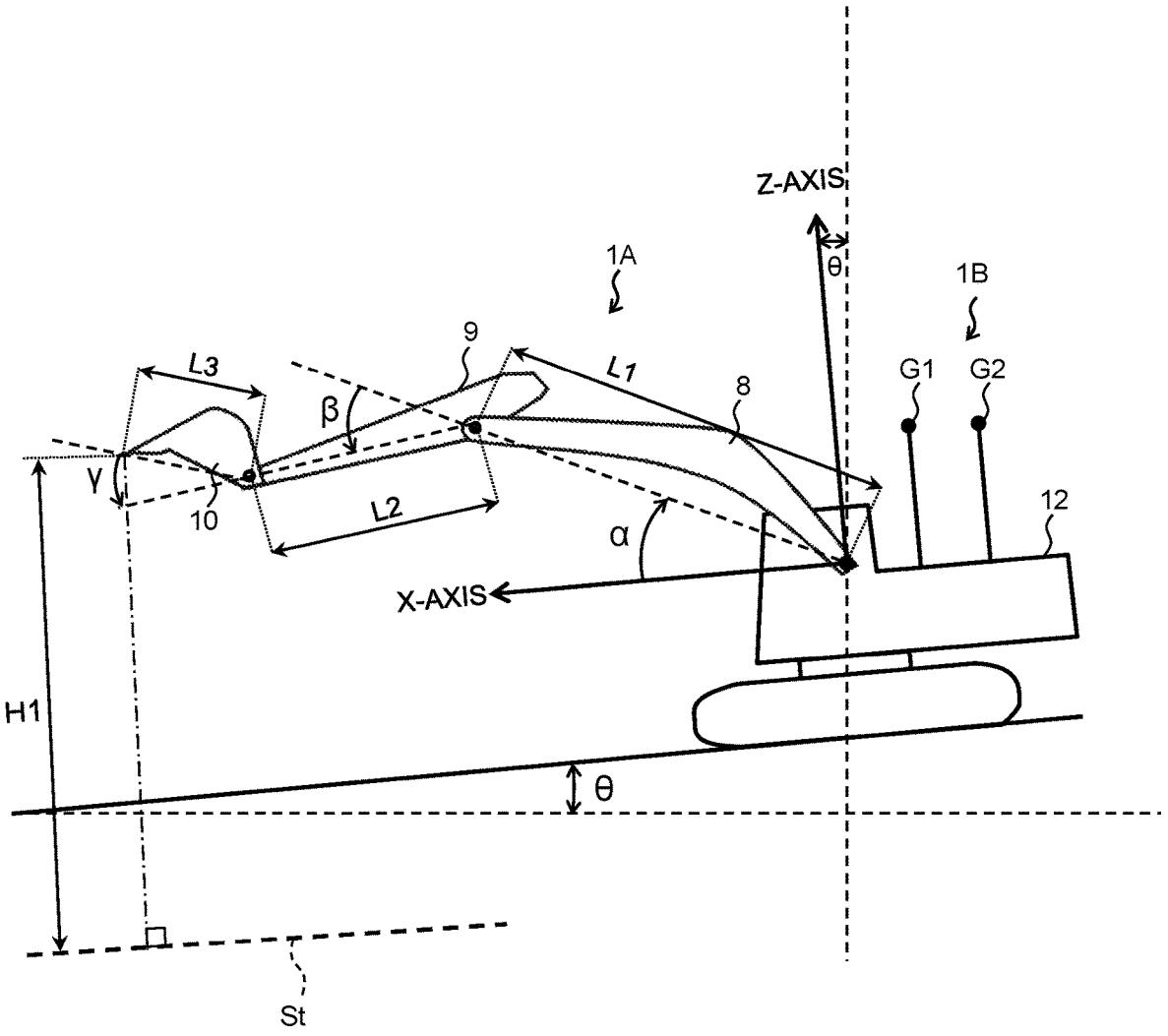
FIG. 4 is a view illustrative of a method of calculating a bucket claw tip position.

FIG. 4 is a view illustrative of a method of calculating a bucket claw tip position.

The posture of the work implement 1A can be defined by a local coordinate system for excavators illustrated in FIG. 4 as a reference. The local coordinate system illustrated in FIG. 4 is a coordinate system established with reference to the swing structure 12 and has an origin at a proximal portion (fulcrum) of the boom 8, a Z-axis established parallel to the central axis about which the swing structure 12 swings (in a direction directly above the swing structure 12), and an X-axis established perpendicularly to the Z-axis (in a direction forward of the swing structure 12). The tilt angle of the boom 8 with respect to the X-axis is referred to as a boom angle α, the tilt angle of the arm 9 with respect to the boom 8 is referred to as an arm angle R, and the tilt angle of the bucket 10 with respect to the arm 9 is referred to as a bucket angle γ. The tilt angle of the vehicle body 1B (the swing structure 12) with respect to the horizontal plane (the reference plane) is referred to as a tilt angle θ. The boom angle α is detected by the angle sensor R1. The arm angle β is detected by the angle sensor R2. The bucket angle γ is detected by the angle sensor R3. The tilt angle θ is detected by the vehicle body tilt angle sensor R4. The boom angle α is a minimum value when the boom 8 is raised to its upper limit (when the boom cylinder 5 is fully elongated), and is a maximum value when the boom 8 is lowered to its lower limit (when the boom cylinder 5 is fully contracted). The arm angle β is a minimum value when the arm cylinder 6 is fully contracted, and is a maximum value when the arm cylinder 6 is fully elongated. The bucket angle γ is a minimum value when the bucket cylinder 7 is fully contracted (in a state of FIG. 4), and is a maximum value when the bucket cylinder 7 is fully elongated.

At this time, the position (Xbk and Zbk) of the bucket claw tip in the local coordinate system is expressed by the following equations (1) and (2):

$$Xbk=L1\cos(\alpha)+L2\cos(\alpha+\beta)+L3\cos(\alpha+\beta+\gamma) \quad (1)$$

$$Zbk=L1\sin(\alpha)+L2\sin(\alpha+\beta)+L3\sin(\alpha+\beta+\gamma) \quad (2)$$

where L1 represents a length from the proximal portion of the boom 8 to the portion thereof that is coupled to the arm 9, L2 a length from the portion of the boom 8 that is coupled to the arm 9 to the portion of the arm 9 that is coupled to the bucket 10, and L3 a length from the portion of the arm 9 that is coupled to the bucket 10 to a tip end of the bucket 10.

—Machine Control—

The controller 40 has an MC function to intervene in operator's operation under certain conditions to limit action of the work implement 1A when at least one of the control lever devices A1 through A3 is operated. MC is performed when the controller 40 controls the solenoid pressure reducing valves V2 through V6, V1', V5', and V6' depending on the bucket claw tip position and the operated situation. The MC function that can be installed in the controller 40 includes "area limiting control" that is carried out when the operator operates the arm with the control lever device A2 and "stop control" and "compaction control" that are carried out when the operator lowers the boom without operating the arm.

The area limiting control is also referred to as "leveling control." While the area limiting control is functioning, at least one of the boom cylinder 5, the arm cylinder 6, and the bucket cylinder 7 is controlled such that the work implement 1A will not excavate an area below the target excavation surface St, and the arm is operated to move the bucket claw tip along the target excavation surface St. Specifically, while the arm is moving due to arm operation, fine movement for raising the boom or lowering the boom is commanded in order to make zero the velocity vector of the bucket claw tip in a direction perpendicular to the target excavation surface St. This is to correct the trajectory of the bucket claw tip brought about by an arm action that is a rotary motion into a linear trajectory along the target excavation surface St.

The stop control is a control for stopping a boom lowering action such that the bucket claw tip will not enter an area below the target excavation surface St, and decelerates a boom lowering action as the bucket claw tip approaches the target excavation surface St while the boom lowering is operated.

The compaction control is a control for allowing compaction work. Compaction work refers to a work for compacting a ground surface by pressing a rear side surface of the bucket 10 forcefully against the ground surface. According to the MC, however, since the velocity at which the bucket claw tip approaches the target excavation surface St is basically reduced in the vicinity of the target excavation surface St, even when the operator operates the boom to lower the boom, intending to compact the target excavation surface St that has been shaped, the bucket 10 cannot be pressed forcefully against the target excavation surface St. While the compaction control is functioning, the deceleration of a boom lowering action is suppressed even if the distance between the target excavation surface St and the bucket claw tip is small (as described later).

—Controller (Hardware)—

Figure 5:
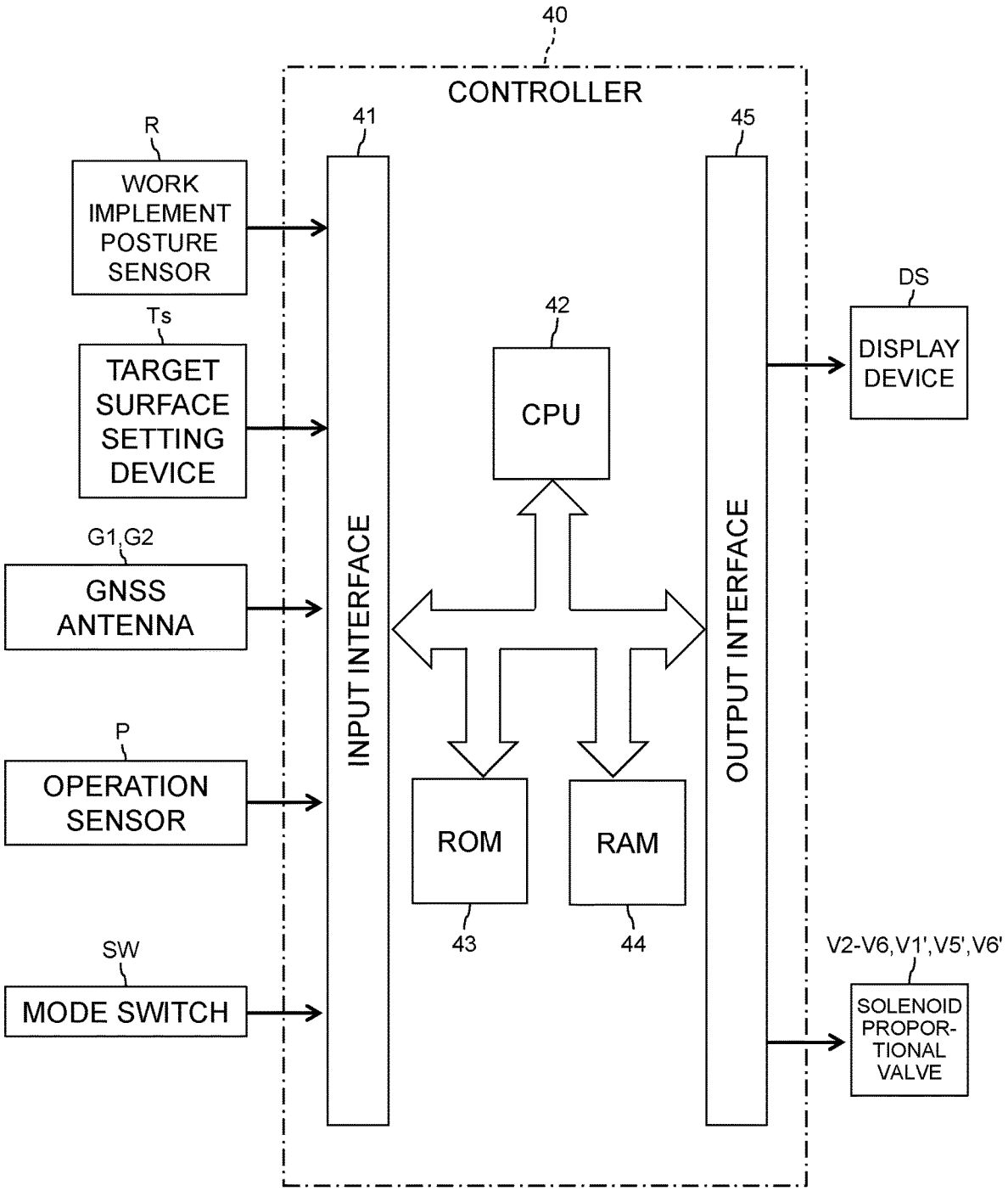
FIG. 5 is a diagram of a hardware configuration of a controller of the hydraulic excavator illustrated in FIG. 1.
Figure 6:
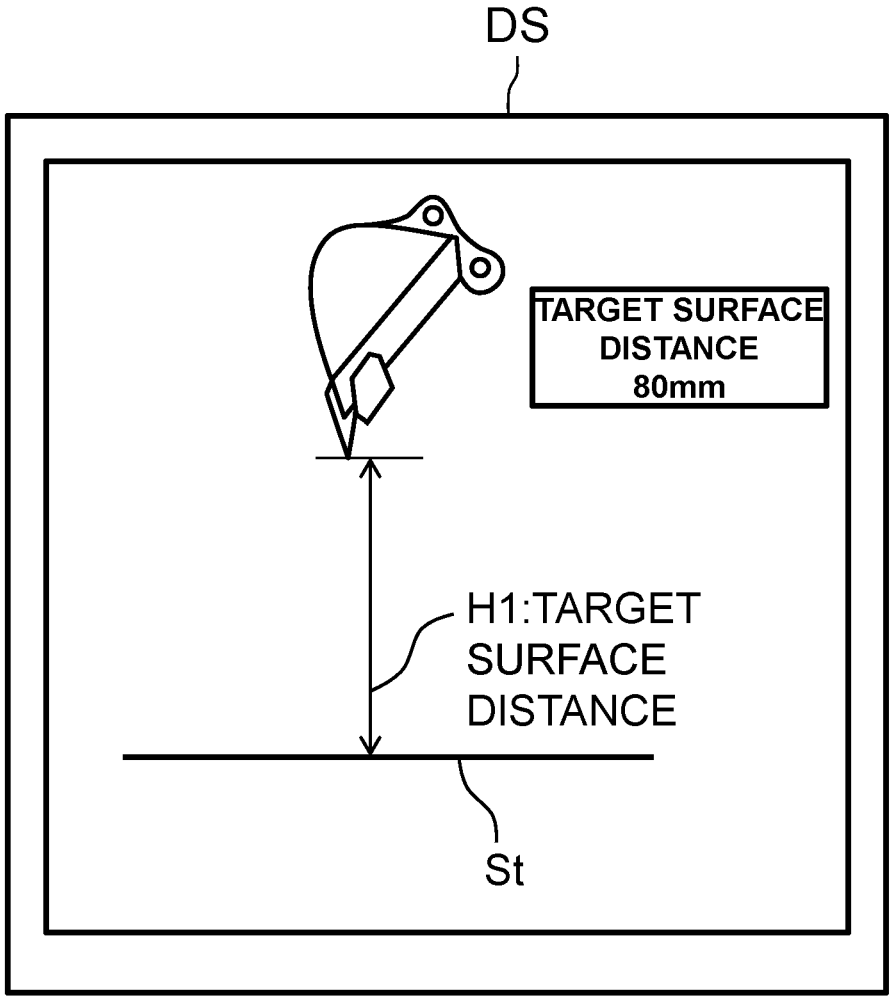
FIG. 6 is a view of an example of a display screen of a display device of the hydraulic excavator illustrated in FIG. 1.

FIG. 5 is a diagram of a hardware configuration of the controller 40 of the hydraulic excavator, and FIG. 6 is a view of an example of a display screen of a display device DS.

The controller 40 illustrated in FIG. 5 is a vehicle-mounted controller and includes an input interface 41, a CPU (Central Processing Unit) 42, a ROM (Read Only Memory) 43, a RAM (Random Access memory) 44, and an output interface 45.

The input interface 41 is supplied with signals input from a posture sensor R, a target surface setting device Ts, the GNSS antennas G1 and G2, an operation sensor P, and a mode switch SW, and converts the supplied signals into digital signals as required for calculations performed by the CPU 42. Note that the posture sensor R includes a plurality of sensors installed for detecting the posture of the work implement LA, the sensors specifically including the angle sensors R1 through R3 and the vehicle body tilt angle sensor R4. The operation sensor P includes the pressure sensors P1 through P6. The target surface setting device Ts is an interface for entering information regarding the target excavation surface St (the information including positional information and tilt angle information of the target excavation surface). The target surface setting device Ts is connected to an external terminal (not shown) that stores therein three-dimensional data on target excavation surfaces defined in a global coordinate system (absolute coordinate system), and is supplied with three-dimensional data on a target excavation surface input from the external terminal. However, a target excavation surface can also manually be input by the operator to the controller 40 via the target surface setting device Ts. The mode switch SW is an input device for setting a work mode.

The ROM 43 stores therein control programs for performing the MC function including processing sequences to be described subsequently with reference to FIGS. 7 through 11 and various pieces of information required to carry out the processing sequences. The RAM 44 stores therein calculated results from the CPU 42 and signals entered from the input interface 41. Note that, according to the present embodiment, the controller 40 is illustrated as including semiconductor memories such as the ROM 43 and the RAM 44 as storage devices. However, the storage devices are not limited to any particular kinds, and may also be magnetic storage devices such as hard disk drives, for example.

The CPU 42 carries out predetermined calculating processing on the basis of signals read from the input interface 41, the ROM 43, and the RAM 44 according to the control programs stored in the ROM 43.

The output interface 45 generates signals to be output on the basis of calculated results from the CPU 42, and outputs the generated signals to the solenoid pressure reducing valves V2 through V6, V1', V5', and V6' and the display device DS, thereby actuating the solenoid pressure reducing valves V2 through V6, V1', V5', and V6' and the display device DS. The display device DS is a liquid crystal monitor of touch panel type and is installed in the operator's cabin 16. As illustrated in FIG. 6, the display device DS displays on its display screen a distance (target surface distance H1) from the target excavation surface St to the claw tip of the bucket 10 as representing a positional relation between the target excavation surface St and the work implement 1A (for example, the bucket 10). The target surface distance H1 is of positive values above the target surface setting device Ts and of negative values below the target surface setting device Ts as a reference. Note that the positional relation illustrated in FIG. 6 can be displayed on the display device DS when the MC function is added or removed by the mode switch SW. The operator can operate the work implement 1A by referring to the displayed positional relation (which is generally called a machine guidance function).

—Controller (Functions)—

Figure 7:
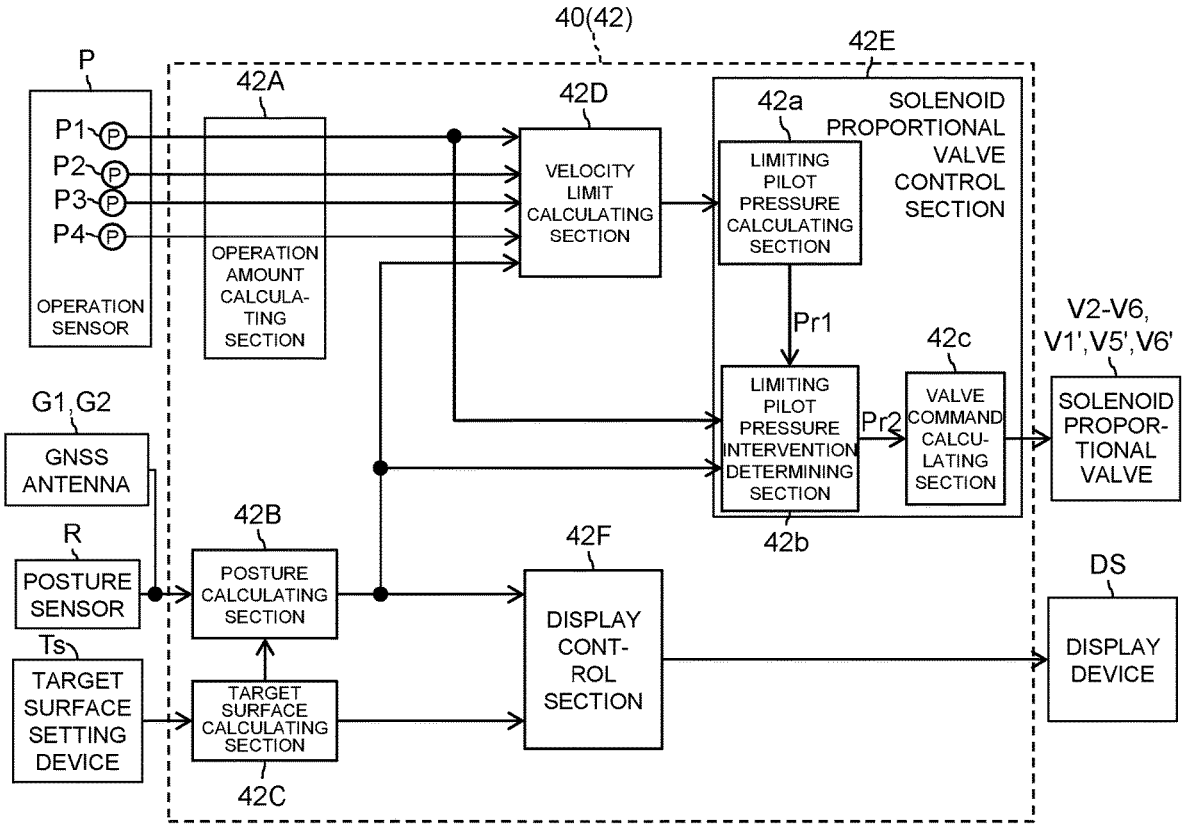
FIG. 7 is a functional block diagram of the controller of the hydraulic excavator illustrated in FIG. 1.
Figure 8:
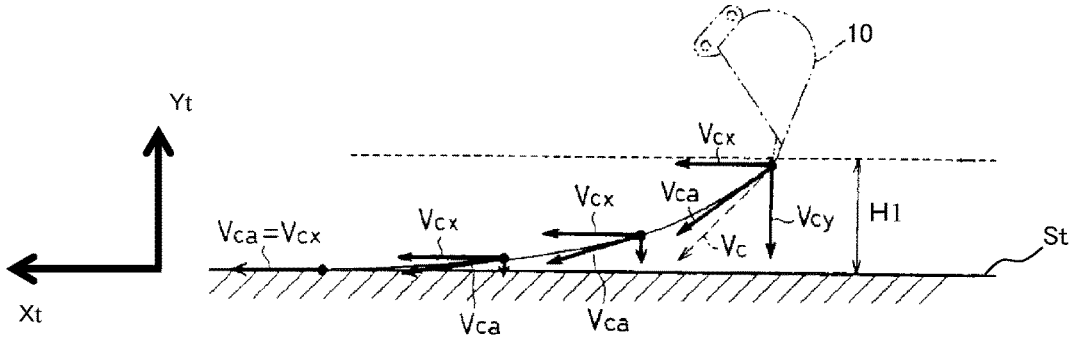
FIG. 8 is a view illustrating an example of a trajectory of a bucket claw tip controlled by machine control.

FIG. 7 is a functional block diagram of the controller 40, and FIG. 8 is a view illustrating an example of the trajectory of the bucket claw tip controlled by MC.

As illustrated in FIG. 7, the CPU 42 of the controller 40 includes an operation amount calculating section 42A, a posture calculating section 42B, a target surface calculating section 42C, a velocity limit calculating section 42D, a solenoid pressure reducing valve control section 42E, and a display control section 42F. The operation amount calculating section 42A, the posture calculating section 42B, the target surface calculating section 42C, the velocity limit calculating section 42D, the solenoid pressure reducing valve control section 42E, and the display control section 42F represent schematized functions of the CPU 42 of the controller 40. The solenoid pressure reducing valve control section 42E further includes a limiting pilot pressure calculating section 42*a*, a limiting pilot pressure intervention determining section 42*b* (hereinafter abbreviated "intervention determining section 42*b*"), and a valve command calculating section 42*c*.

(1) Operation Amount Calculating Section

The operation amount calculating section 42A calculates operation amounts of the control lever devices A1, A2, and A3 (the control levers B1 and B2) on the basis of detected values from the operation sensor P (the pressure sensors P1 through P6). The operation amount calculating section 42A calculates an operation amount for boom raising from the detected value from the pressure sensor P1, calculates an operation amount for boom lowering from the detected value from the pressure sensor P2, calculates an operation amount for arm crowding (arm pulling) from the detected value from the pressure sensor P3, and calculates an operation amount for arm dumping (arm pushing) from the detected value from the pressure sensor P4. The operation amount calculating section 42A calculates an operation amount for bucket crowding from the detected value from the pressure sensor P5, and calculates an operation amount for bucket dumping from the detected value from the pressure sensor P6. The operation amounts converted from the detected values from the pressure sensors P1 through P6 by the operation amount calculating section 42A are output to the velocity limit calculating section 42D.

Note that the calculation of operation amounts on the basis of the detected values from the pressure sensors P1 through P6 is by way of example only. Operation amounts of the control levers may be detected by positional sensors (for example, rotary encoders) that detect angular displacements of the control levers of the control lever devices A1 through A3, for example.

(2) Posture Calculating Section

The posture calculating section 42B calculates a posture of the work implement 1A and a position of the claw tip of the bucket 10 in the local coordinate system on the basis of detected signals from the posture sensor R. The position (Xbk and Zbk) of the claw tip of the bucket 10 can be calculated according to the equations (1) and (2) as described above. When a posture of the work implement 1A and a position of the claw tip of the bucket 10 in the global coordinate system are required, the posture calculating section 42B calculates a position and posture in the global coordinate system of the swing structure 12 from the signals from the GNSS antennas G1 and G2, and converts the local coordinate system into the global coordinate system.

(3) Target Surface Calculating Section

The target surface calculating section 42C calculates positional information of a target excavation surface St on the basis of information entered via the target surface setting device Ts, and the calculated positional information of the target excavation surface St is recorded in the RAM 44. According to the present embodiment, information of a cross section (a two-dimensional target excavation surface illustrated in FIG. 4 earlier) produced by cutting a target excavation surface provided as three-dimensional data via the target surface setting device Ts with a plane in which the work implement 1A moves (a motion plane of the work implement) is calculated as positional information of the target excavation surface St.

Note that, in the example illustrated in FIG. 4, there is only one target excavation surface St. However, there are also cases where a plurality of target excavation surfaces exist. When there are a plurality of target excavation surfaces, for example, there are available a method of establishing one of them that is closest to the bucket claw tip as a target excavation surface, a method of establishing one of them that is positioned vertically below the bucket claw tip as a target excavation surface, a method of establishing any one of them optionally selected as a target excavation surface and the like.

(4) Velocity Limit Calculating Section

The velocity limit calculating section 42D calculates respective velocity limits (limit values for elongation velocities) for the boom cylinder 5, the arm cylinder 6, and the bucket cylinder 7 at a time of MC (at a time of area limiting control) on the basis of the signals from the posture sensor R so that the work implement 1A will not excavate soil beyond the target excavation surface St. According to the present embodiment, first, respective primary target velocities for the boom cylinder 5, the arm cylinder 6, and the bucket cylinder 7 are calculated on the basis of the operation amounts of the control lever devices A1 through A3 that are entered from the operation amount calculating section 42A. Then, a target velocity vector Vc (FIG. 8) of the bucket claw tip is determined from the primary target velocities, the position of the bucket claw tip determined by the posture calculating section 42B, and the dimensions of the various parts (such as L1, L2, and L3 described above) of the work implement 1A that are stored in the ROM 43. Then, the primary target velocity of one or more of the boom cylinder 5, the arm cylinder 6, and the bucket cylinder 7 is restrictively corrected such that a component Vcy of the target velocity vector Vc that is perpendicular to the target excavation surface St will be closer to zero as the bucket 10 is lowered to make the target surface distance H1 closer to zero. By calculating the velocity limits for the boom cylinder 5, the arm cylinder 6, and the bucket cylinder 7 in this manner, the target velocity vector Vc of the bucket claw tip depending on operator's operation is converted into Vca (FIG. 8) (under directional conversion control) as illustrated in FIG. 8. The velocity vector Vca ($\neq 0$) when the target surface distance H1 is zero has only a component Vcx parallel to the target excavation surface St. In this manner, the bucket claw tip is held in an area above the target excavation surface St such that the bucket claw tip will not enter an area below the target excavation surface St.

At this time, the directional conversion control may be carried out in a combination of boom raising or boom lowering and arm crowding or in a combination of boom raising or boom lowering and arm dumping. Even in either case, when the target velocity vector Vc includes a downward component ($Vcy<0$) toward the target excavation surface St, the velocity limit calculating section 42D calculates a velocity limit for the boom cylinder 5 in a boom raising direction to cancel out the downward component. Conversely, when the target velocity vector Vc includes an upward component ($Vcy>0$) away from the target excavation surface St, the velocity limit calculating section 42D calculates a velocity limit for the boom cylinder 5 in a boom lowering direction to cancel out the upward component. Furthermore, taking into account response delays of the solenoid pressure reducing valves V2 and V1' and the like. for the boom action, a ratio at which a velocity limit for arm crowding increases is limited and output immediately after an arm crowding operation. Similarly, a ratio at which a velocity limit for arm dumping increases is limited and output immediately after an arm dumping operation.

Note that, when no area limiting control is carried out, the velocity limit calculating section 42D calculates and outputs velocity limits (primary target velocities) for the hydraulic cylinders depending on the operation of the control lever devices A1 through A3 as they are as velocity limits.

The velocity limits calculated by the velocity limit calculating section 42D are output to the limiting pilot pressure calculating section 42*a*.

(5) Limiting Pilot Pressure Calculating Section

The limiting pilot pressure calculating section 42*a* calculates a limiting pilot pressure Pr1 for the flow control valves D1, D2, and D3 corresponding respectively to the boom cylinder 5, the arm cylinder 6, and the bucket cylinder 7 on the basis of the velocity limits calculated by the velocity limit calculating section 42D. The limiting pilot pressure Pr1 calculated by the limiting pilot pressure calculating section 42*a* is output to the intervention determining section 42*b*.

(6) Limiting Pilot Pressure Intervention Determining Section

The intervention determining section 42*b* determines a final limiting pilot pressure Pr2 on the basis of the limiting pilot pressure Pr1 calculated by the limiting pilot pressure calculating section 42*a*, with a change added thereto under certain conditions as required. Specifically, in a situation for suppressing limitation on motion velocities under MC for boom lowering, arm dumping, and arm crowding, the limiting pilot pressure Pr2 for the pressure bearing chambers E2 through E4 of the flow control valves D1 and D2 that have been calculated by the limiting pilot pressure calculating section 42*a* is changed in an increasing direction. Because of the function of the intervention determining section 42*b*, even in a situation where the actuator speeds are limited under MC, the openings of the solenoid pressure reducing valves V2 through V4 increase from the original openings (openings based on the velocity limits calculated by the velocity limit calculating section 42D) under MD under a certain condition. In this case, limitation under MC on the actions of boom lowering, arm dumping, and arm crowding is eased up. The limiting pilot pressure is changed by the intervention determining section 42*b* on the basis of the target surface distance H1, the situation of a boom raising operation, and the limiting pilot pressures corresponding respectively to the actions of arm crowding, arm dumping, and boom lowering. When there is no need to change the limiting pilot pressure, the limiting pilot pressure Pr2 determined by the intervention determining section 42*b* becomes the limiting pilot pressure Pr1 determined by the limiting pilot pressure calculating section 42*a* (the pilot pressure based on the velocity limits calculated by the velocity limit calculating section 42D). A processing sequence of the intervention determining section 42*b* will be described later with reference to FIG. 9.

(7) Valve Command Calculating Section

The valve command calculating section 42*c* calculates an electric signal based on the limiting pilot pressure Pr2 determined by the intervention determining section 42*b*, and outputs the determined electric signal to the solenoid pressure reducing valves V2 through V6, V1', V5', and V6'. The electric signal output from the valve command calculating section 42*c* energizes the solenoids of the solenoid pressure reducing valves V2 through V6, V1', V5', and V6', actuating the solenoid pressure reducing valves V2 through V6, V1', V5', and V6', so that the pilot pressure acting on the flow control valves D1 through D3 is limited by the limiting pilot pressure Pr2, depending on a situation. When the operator operates the control lever device A2, intending to excavate soil horizontally with an arm crowding action, for example, the solenoid pressure reducing valves V1' and V3' are controlled depending on a situation such that the bucket claw tip will not enter an area below the target excavation surface St. In this case, a decelerating action of arm crowding and a boom raising action are automatically combined with an arm crowding action depending on operator's operation, performing a horizontal excavating operation only with an arm crowding operation while being assisted by the controller 40. On the other hand, while a boom raising operation signal is being output from the control lever device A1, the openings of the solenoid pressure reducing valves V2 through V4 are determined to be larger than an opening based on the velocity limits by the intervention determining section 42*b* determining to intervene in a target pilot pressure, as described later with reference to FIG. 9. Even under conditions in which motion velocities are originally limited under MC, limitations on actions for arm crowding, arm dumping, and boom lowering are eased up.

—Solenoid Valve Opening Determining Procedure—

Figure 9:
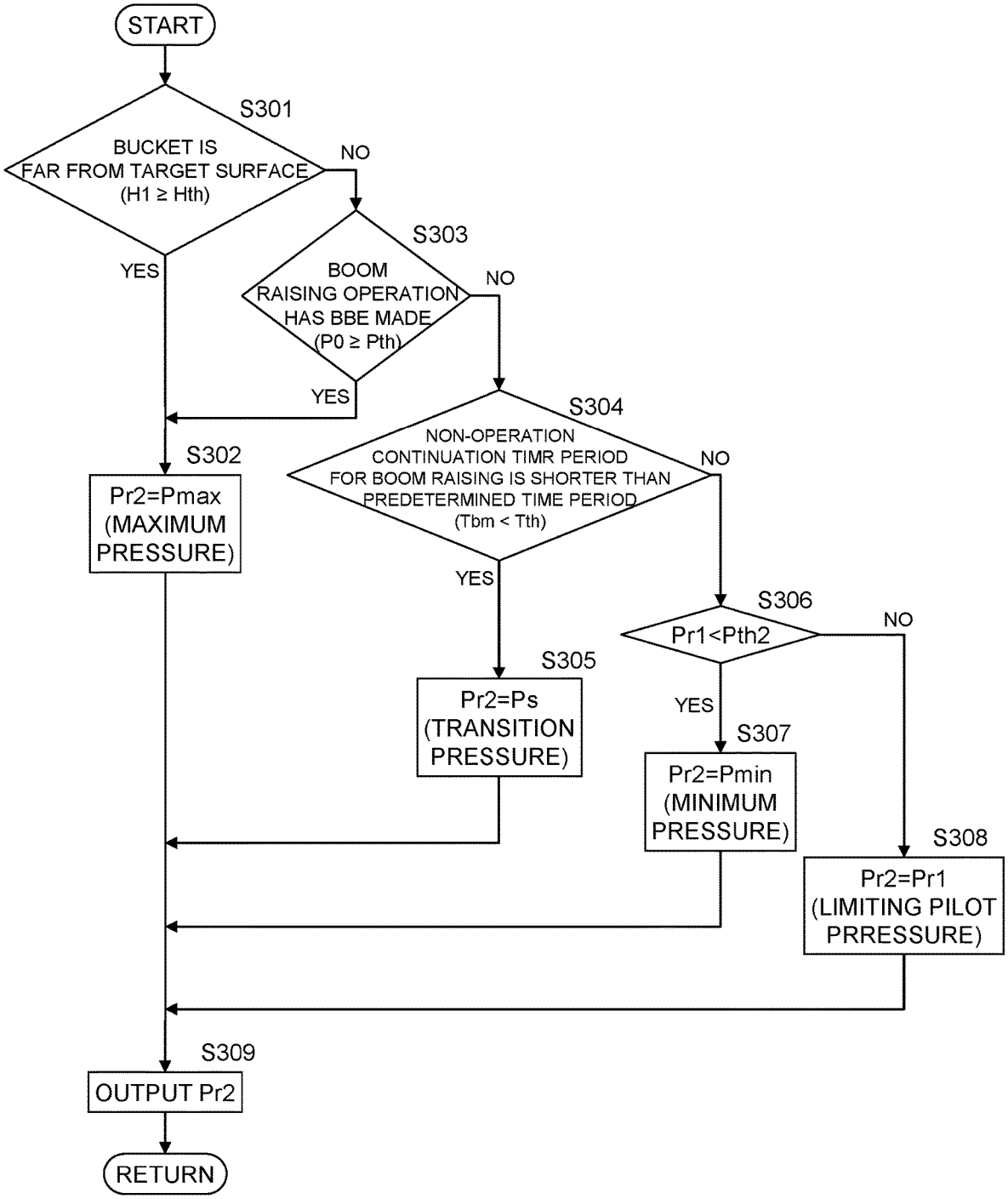
FIG. 9 is a flowchart of a procedure for determining a limiting pilot pressure with respect to arm crowding, arm dumping, and boom lowering, carried out by the controller of the hydraulic excavator illustrated in FIG. 1.

FIG. 9 is a flowchart of a procedure for determining the limiting pilot pressure Pr2 with respect to arm crowding, arm dumping, and boom lowering, carried out by the intervention determining section 42*b*. The intervention determining section 42*b* repeatedly carries out the procedure illustrated in FIG. 9 in predetermined periods (1 ms, for example). The intervention determining section 42*b* has such a characteristic function that, while the control lever device A1 is being operated for boom raising, the intervention determining section 42*b* increases the setting of the limiting pilot pressure Pr2 for arm crowding and arm dumping actions to a maximum pressure Pmax. The maximum pressure Pmax is a maximum pressure that can be output to the pressure bearing chambers E2 through E4 of the flow control valves D1 and D2 in the circuit illustrated in FIG. 3, and is higher than the limiting pilot pressure Pr1 calculated on the basis of the velocity limits by the limiting pilot pressure calculating section 42*a*.

When the processing sequence illustrated in FIG. 9 is started, the intervention determining section 42*b* determines whether the bucket claw tip is sufficiently spaced from the target excavation surface St on the basis of the target surface distance H1 input from the posture calculating section 42B (S301). The intervention determining section 42*b* here determines whether the bucket claw tip is sufficiently spaced from the target excavation surface St by checking if H1≥Hth or not. Hth represents a preset distance (>0) with respect to the target surface distance H1. Also, if a preset distance of the bucket claw tip from the target excavation surface St that defines an area in which the solenoid pressure reducing valves V2 through V6, V1', V5', and V6' are controlled under MC (the work implement 1A is limited in action under MC) is represented by H2, then H2 Hth. From the standpoint of properly functioning MC, it is preferable that H2<Hth. If H1 Hth, then the intervention determining section 42*b* determines that the bucket claw tip is sufficiently spaced from the target excavation surface St, and the sequence goes to step S302. If H1<Hth, then the intervention determining section 42*b* determines that the bucket claw tip is close to the target excavation surface St, and the sequence goes to step S303.

If H1≥Hth, the intervention determining section 42*b* determines the limiting pilot pressure Pr2 for the pressure bearing chambers E2 through E4 of the flow control valves D1 and D2 to be the maximum pressure Pmax unconditionally in order to maximize the openings of the solenoid pressure reducing valves V2 through V4 (step S302).

If H1<Hth, then the intervention determining section 42*b* determines whether a boom raising operation has been made on the basis of the detected signal (pressure) P0 from the pressure sensor P1 (step S303). The intervention determining section 42*b* here determines whether a boom raising operation has been made by checking if P0≥Pth or not. Pth refers to a preset threshold value stored in the ROM 43 with respect to the detected signal P0 from the pressure sensor P1, and represents a pilot pressure with which the boom 8 starts to be raised. If P0 Pth, then the intervention determining section 42*b* determines that a boom raising operation has been made, and the sequence goes to step S302. If P0<Pth, then the intervention determining section 42*b* determines that no boom raising operation has been made, and the sequence goes to step S304. As a result, during the boom raising operation, the solenoid pressure reducing valves V2 through V4 are unconditionally in a standby state with maximum openings, and the MC is canceled irrespective of the target surface distance H1 with respect to arm crowding, arm dumping, and boom lowering operations. Therefore, when an arm crowding operation or an arm dumping operation, for example, is made at the same time as the boom raising operation, the arm 9 can be moved in a crowding direction or a dumping direction at a velocity depending on the operation without being limited by the MC function.

On the other hand, when the bucket claw tip is close to the target excavation surface St and no boom raising operation has been made, the intervention determining section 42*b* determines whether a non-operation continuation time period Tbm [s] for boom raising is shorter than Tth [s] (step S304). Tth refers to a predetermined time period preset as a threshold value preset with respect to the non-operation continuation time period Tbm and stored in the ROM 43. The intervention determining section 42*b* here determines whether a time period (=Tbm) that has elapsed from a time period Tbm=0 when the detected signal P0 from the pressure sensor P1 changes from Pth or higher to a value lower than Pth is shorter than Tth. In the intervention determining section 42*b*, if Tbm<Tth, then the sequence goes to S305, and if Tbm Tth, then the sequence goes to S306.

Until the boom raising operation stops and the predetermined time period Tth is reached (Tbm<Tth), the intervention determining section 42*b* calculates a transition pressure Ps depending on the non-operation continuation time period Tbm with respect to arm crowding, arm dumping, and boom lowering. Then, the transition pressure Ps is determined as the limiting pilot pressure Pr2 with respect to arm crowding, arm dumping, and boom lowering (step S305). As described later in detail, the transition pressure Ps that is calculated here is a value for returning (for example, monotonously reducing) the openings of the solenoid pressure reducing valves V2 through V4 from the maximum opening (the opening with the MC function canceled) to the opening depending on the limiting pilot pressure Pr1 (the opening with the MC function activated) over the predetermined time period Tth. During a period in which the transition pressure Ps is set as the limiting pilot pressure, the MC function is semi-canceled (MC-based limitation becomes stronger as time elapses) with respect to arm crowding, arm dumping, and boom lowering.

When the non-operation continuation time period Tbm has reached the predetermined time period Tth, the intervention determining section 42*b* determines whether the limiting pilot pressure Pr1 calculated by the limiting pilot pressure calculating section 42*a* with respect to arm crowding, arm dumping, and boom lowering is lower than a threshold value Pth2 (step S306). Pth2 refers to a preset threshold value preset for the limiting pilot pressure Pr1 calculated by the limiting pilot pressure calculating section 42*a* with respect to each of actions of arm crowding, arm dumping, and boom lowering, and represents a pressure at which each of operations of arm crowding, arm dumping, and boom lowering starts, for example. Since the limiting pilot pressure Pr1 can be different for each of actions of arm crowding, arm dumping, and boom lowering, the determined result in step S306 can also be different for each of actions of arm crowding, arm dumping, and boom lowering. The flowchart illustrated in FIG. 9 is shared by each of actions of arm crowding, arm dumping, and boom lowering. Strictly, however, the sequence illustrated in FIG. 9 is carried out individually with respect to these three actions.

If the limiting pilot pressure is lower than Pth2, then the intervention determining section 42*b* determines a minimum pressure Pmin to be the limiting pilot pressure Pr2 (step S307). If the limiting pilot pressure Pr1 is equal to or higher than Pth2, then the intervention determining section 42*b* determines the limiting pilot pressure Pr1 to be the limiting pilot pressure Pr2 (step S308). MC functions normally in the branch from step S306 to step S308.

When the limiting pilot pressure Pr2 is determined in steps S302, S305, S307, and S309, the intervention determining section 42*b* outputs the determined limiting pilot pressure Pr2 to the valve command calculating section 42*c*, whereupon the sequence goes back to step S301 (step S309).

—Transition Pressure Calculating Process—

Figure 10:
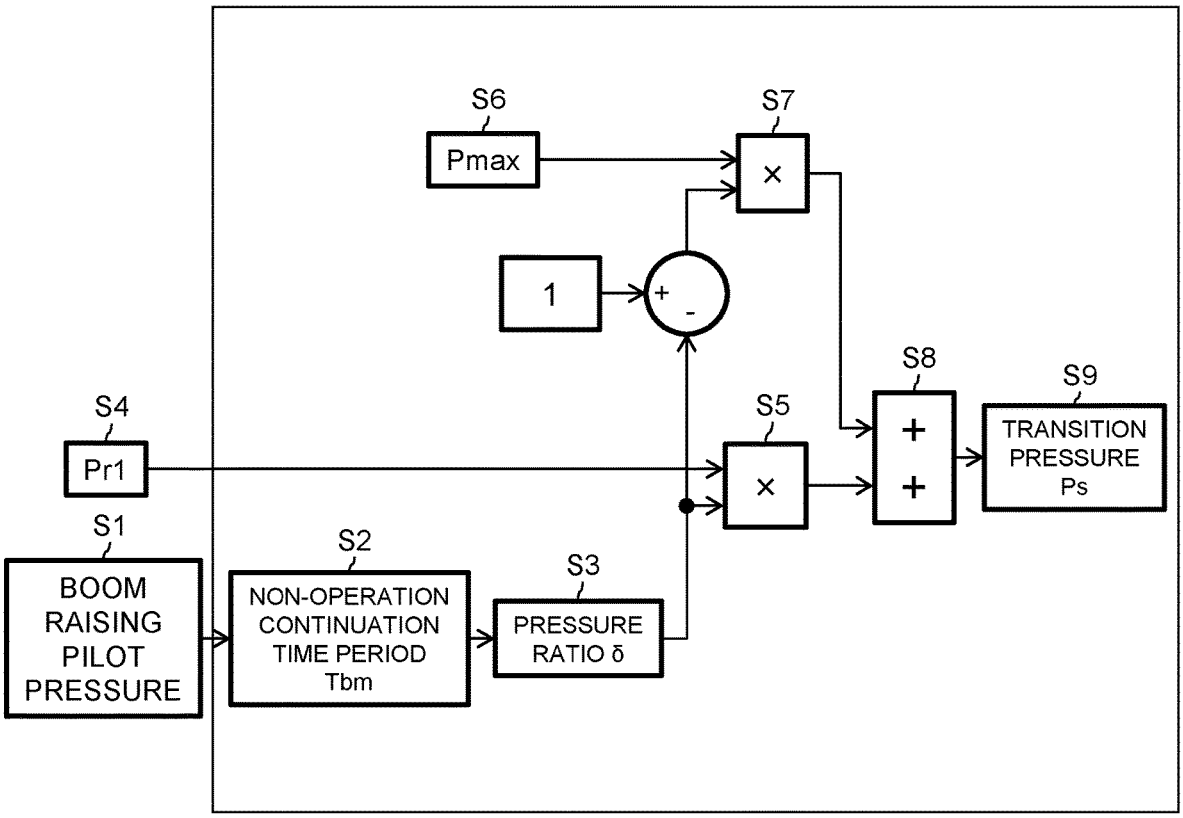
FIG. 10 is a block diagram illustrating a logic for calculating a transition pressure according to the first embodiment of the present invention.

FIG. 10 is a block diagram illustrating a logic of the intervention determining section 42*b* for calculating a transition pressure in step S305 of the flowchart illustrated in FIG. 9. A transition pressure as a transient limiting pilot pressure is calculated for each of actions of boom lowering, arm crowding, and arm dumping by the calculating logic illustrated in FIG. 10. The calculation of a transition pressure for an arm crowding action will be described below as a representative example with reference to FIG. 10. However, transition pressures for respective actions of arm dumping and boom lowering are similarly calculated.

Figure 11:
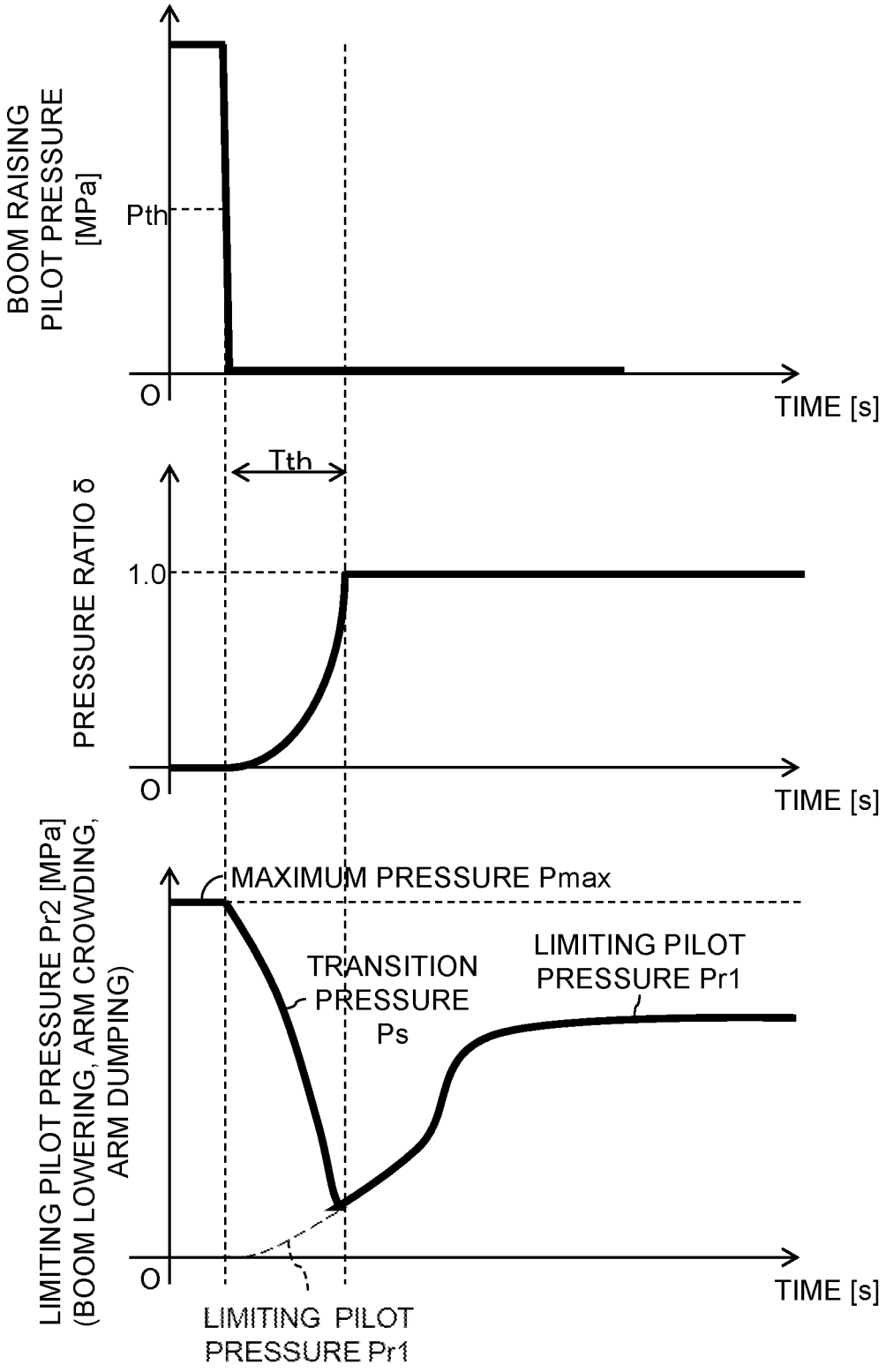
FIG. 11 is a diagram illustrating a relation between the limiting pilot pressure calculated by the procedure illustrated in FIG. 9 and boom raising operation.

For calculating a transition pressure, the boom raising pilot pressure calculated by the operation amount calculating section 42A is input (S1), and a time (the non-operation continuation time period Tbm) that has elapsed from the time when the boom raising pilot pressure has changed from Pth to a value lower than Pth is calculated (S2). The non-operation continuation time period Tbm is reset to zero each time the boom raising pilot pressure becomes equal to or higher than Pth. The calculated non-operation continuation time period Tbm is input to a pressure ratio table, and a pressure ratio δ (FIG. 11) is calculated on the basis of the pressure ratio table (S3). The pressure ratio δ refers to a proportion of the limiting pilot pressure Pr1 (a value depending on a target velocity) for arm crowding in the transition pressure Ps. The pressure ratio table is established such that the pressure ratio δ increases from 0 (minimum) to 1.0 (maximum) while the non-operation continuation time period Tbm for boom raising varies from 0 to the predetermined time period Tth (FIG. 11). Furthermore, the limiting pilot pressure Pr1 for arm crowding is input (S4), and the limiting pilot pressure Pr1 is multiplied by the pressure ratio δ calculated on the basis of the pressure ratio table (S5). In addition, a prescribed maximum pressure Pmax that can act on the pressure bearing chamber E3 of the flow control valve D2 with respect to the arm crowding action is input from the ROM 43 (S6), and is multiplied by (1-δ) (S7). The product of the maximum pressure Pmax and (1-δ) is added to the product of the limiting pilot pressure Pr1 and δ (S8), and the sum is output as a transition pressure Ps (S9).

FIG. 11 is a diagram illustrating the relation between the limiting pilot pressure Pr2 calculated by the procedure illustrated in FIG. 9 and a boom raising operation. As illustrated in FIG. 11, during boom raising operation, the maximum pressure Pmax becomes the limiting pilot pressure Pr2, and for the predetermined time period Tth after the boom raising operation has stopped, the transition pressure Ps becomes the limiting pilot pressure Pr2. After elapse of the predetermined time period Tth after the boom raising operation has stopped, the limiting pilot pressure Pr1 becomes the limiting pilot pressure Pr2. Variations of the limiting pilot pressure Pr1 in FIG. 11 are one example. With respect to the calculation of the transition pressure Ps, the pressure ratio δ is prescribed to increase monotonously from 0 to 1.0 over the predetermined time period Tth after the boom raising pilot pressure has varied from an operated state (Pth or higher) to a non-operated state (lower than Pth). By prescribing the pressure ratio table in this manner, when the boom raising operation has stopped as illustrated in FIG. 11, the transition pressure Ps decreases monotonously from the maximum pressure Pmax to the limiting pilot pressure Pr1 over the predetermined time period Tth under the condition that the target surface distance H1 is smaller than Hth.

—Action—

The present embodiment is characterized in the control of the solenoid pressure reducing valves V2 through V4 with respect to boom lowering, arm crowding, and arm dumping carried out by the solenoid valve unit 160. Action of the solenoid valve unit 160 under certain conditions will be described hereinbelow.

(1) When the Bucket Claw Tip is Sufficiently Spaced from the Target Excavation Surface St When the target surface distance H1 calculated by the posture calculating section 42B is equal to or larger than Hth, there is no danger of the work implement 1A interfering with the target excavation surface St, and it is not necessary to intervene in operator's operation to perform deceleration control over boom lowering, arm crowding, and arm dumping. Therefore, irrespectively of the degree of operation, the limiting pilot pressure Pr2 for arm crowding, arm dumping, and boom lowering is set to the maximum pressure Pmax, controlling the solenoid pressure reducing valves V2 through V4 to operate in an opening direction (to be opened according to the present embodiment). Pilot pressures generated by the control lever devices A1 and A2 depending on operator's operation thus act on the pressure bearing chambers E2 through E4 of the flow control valves D2 and D3, so that the boom and the arm are actuated at velocities depending on operator's operation.

(2) When the Bucket Claw Tip is Close to the Target Excavation Surface St

Even in a situation where the target surface distance H1 is smaller than Hth, during the boom raising operation, the limiting pilot pressure Pr2 is set to the maximum pressure Pmax irrespectively of the degree of operation with respect to arm crowding, arm dumping, and boom lowering, opening the solenoid pressure reducing valves V2 through V4. According to the present embodiment, the boom raising operation triggers automatic cancelation of MC with respect to arm crowding, arm dumping, and boom lowering, irrespectively of the target surface distance H1 even though the mode switch SW (FIG. 5) is not operated. Pilot pressures generated by the control lever devices A1 and A2 depending on operator's operation thus act on the pressure bearing chambers E2 through E4 of the flow control valves D2 and D3, so that the boom 8 and the arm 9 are actuated at velocities depending on operator's operation.

Also, according to the present embodiment, when the boom raising operation has stopped, if the target surface distance H1 is smaller than Hth, then the actions of the solenoid pressure reducing valves V2 through V4 do not return immediately to an action under MC. For the predetermined time period Tth from the stopping of the boom raising operation, the limiting pilot pressure Pr2 is set to the transition pressure Ps, irrespectively of the degree of operation with respect to each of actions of arm crowding, arm dumping, and boom lowering. Thus, with respect to the solenoid pressure reducing valves V2 through V4, MC is semi-canceled, making the effect of MC-based action limitation stronger as time elapses from the state in which the boom 8 and the arm 9 are actuated depending on operator's operation. When the predetermined time period Tth elapses without a boom raising operation, the actions of the solenoid pressure reducing valves V2 through V4 return to a normal action under MC.

Advantages (1) According to the present embodiment, while a boom raising operation is being made through the control lever device A1, the openings of the solenoid pressure reducing valves V2 and V3 corresponding to arm crowding and arm dumping actions are made larger than an opening based on the velocity limit (a maximum opening according to the present embodiment). Thus, it is possible to intervene in MC and make smooth compaction work and the like including arm crowding and arm dumping actions of the work implement 1A with good response in the vicinity of the target excavation surface St.

In a situation where MC-based assistance is required, mainly an arm operation is made, and a boom raising operation is not generally made. Paying attention to this point, according to the present embodiment, the boom raising operation triggers automatic cancelation of MC with respect to a particular solenoid pressure reducing valve, irrespectively of the target surface distance H1, even though the mode switch SW is not operated, for example. According to the present embodiment, compaction work and the like with no leveling (MC) intended is assumed, and the solenoid pressure reducing valves V2 through V4 strongly related to such work are opened. In this case, when positional alignment is performed by the arm operation after the target excavation surface St and the bucket 10 have been distanced from each other by the boom raising operation in the vicinity of the target excavation surface St, the arm 9 is actuated at a velocity depending on the operation for increased work efficiency even under MC, making the operator less mentally fatigued. The same advantage is achieved also when the bucket 10 is positionally aligned by composite the operations for boom raising and arm crowding (or dumping).

(2) According to the present embodiment, after the boom raising operation has stopped, the openings of the solenoid pressure reducing valves V2 through V4 are monotonously reduced, and returned to an opening based on the limiting pilot pressure Pr1 in the predetermined time period Tth from the stopping of the boom raising operation. MC-based limitation on a boom lowering action after boom raising upon compaction work, for example, is thus suppressed as well, resulting in great advantages of increased work efficiency and reduced operator's mental fatigue.

Furthermore, since the longer the predetermined time period Tth is, the longer the time in which the openings of the solenoid pressure reducing valves V2 through V4 are larger than values under MC is, a long period of time can be secured for improving the responses of arm crowding, arm dumping, and boom lowering after the boom raising operation. Conversely, the shorter the predetermined time period Tth is, the more effective the MC-based original limitation is on the actions of arm crowding, arm dumping, and boom lowering early after the boom raising operation, thereby restraining the work implement from excavating soil beyond the target excavation surface St. The response of the work implement 1A and the protectability of the target excavation surface St can flexibly be adjusted by adjusting the predetermined time period Tth.

Second Embodiment

Figure 12:
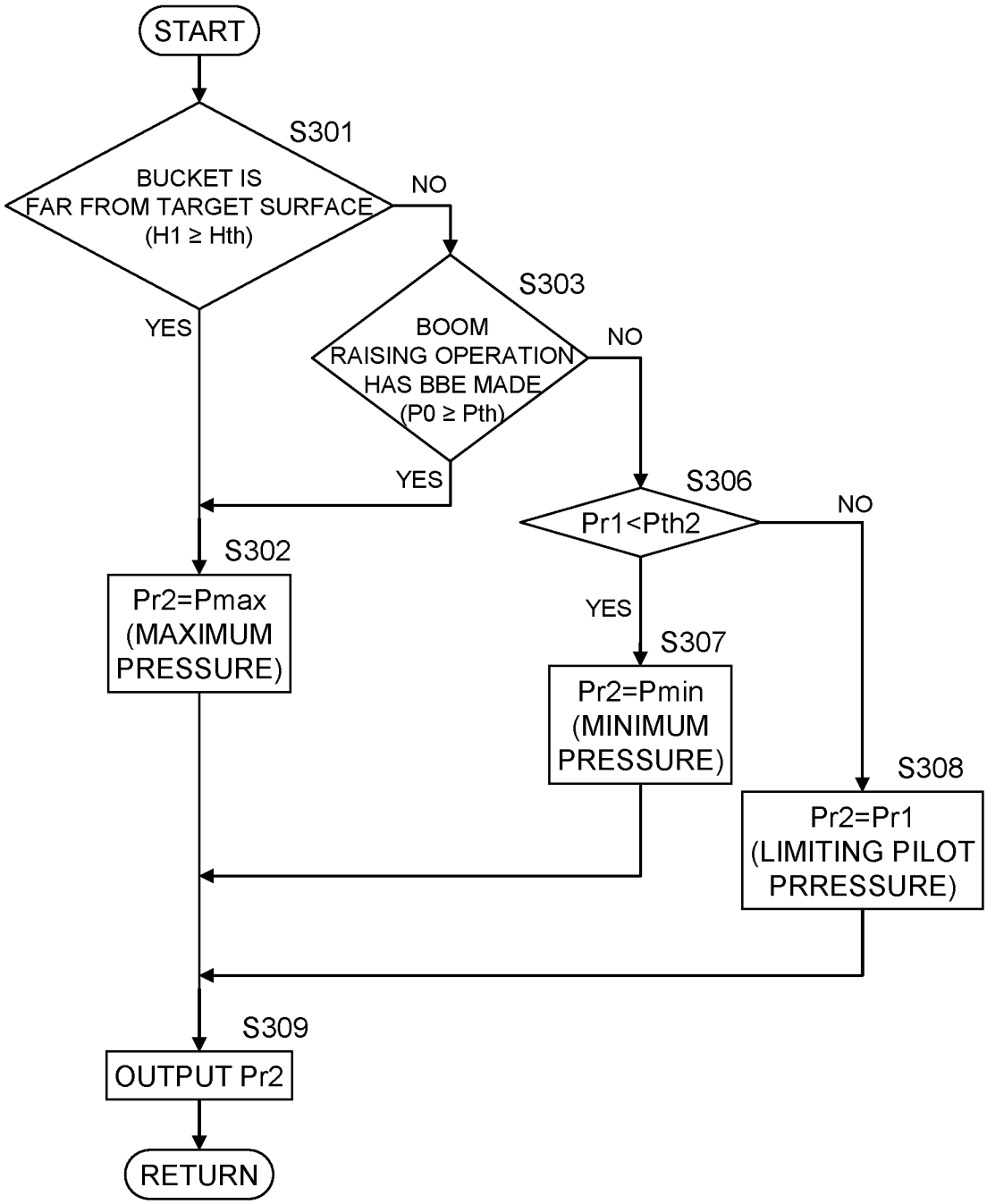
FIG. 12 is a flowchart of a procedure for determining a limiting pilot pressure with respect to arm crowding, arm dumping, and boom lowering, carried out by a controller of a hydraulic excavator according to a second embodiment of the present invention, the flowchart corresponding to FIG. 9 according to the first embodiment.
Figure 13:
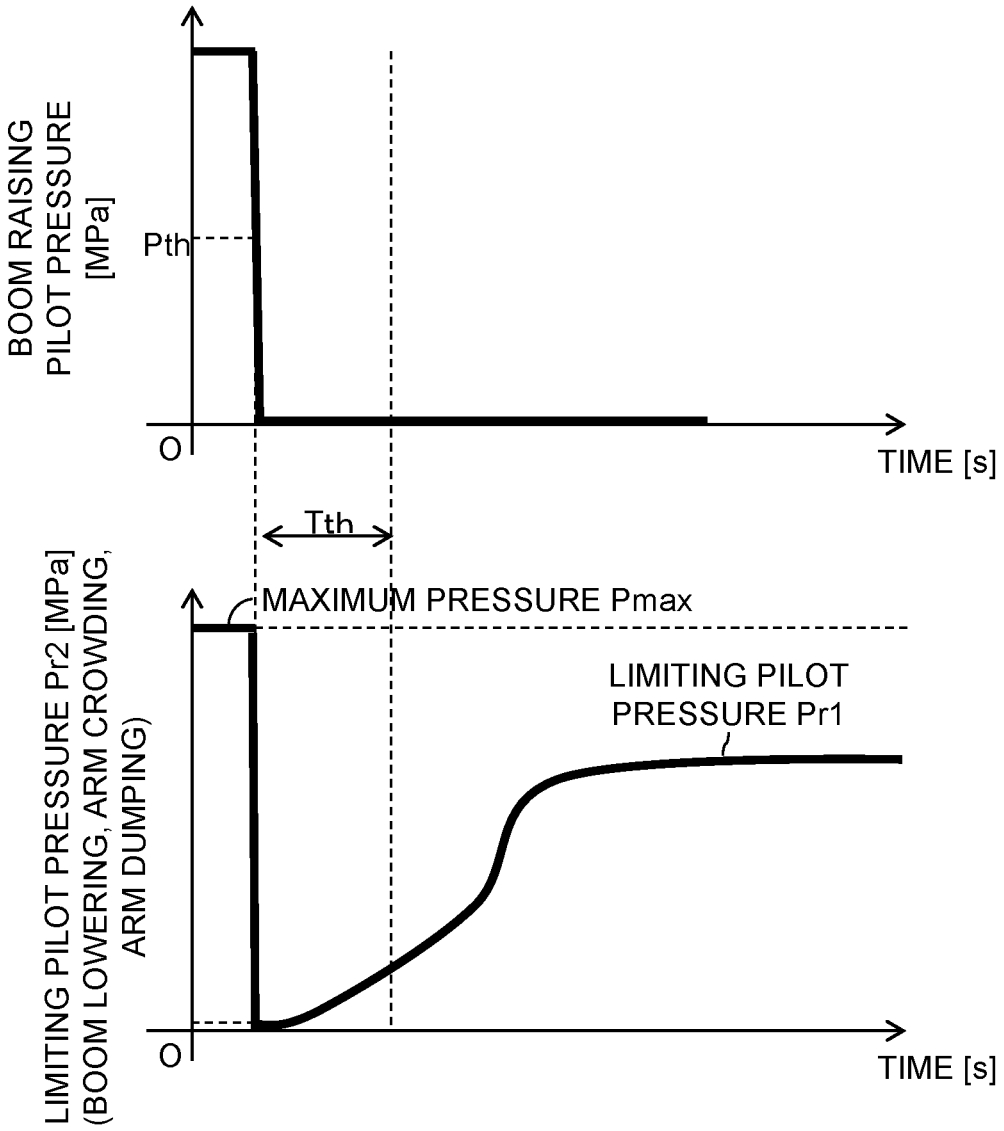
FIG. 13 is a diagram illustrating a relation between the limiting pilot pressure calculated by the procedure illustrated in FIG. 12 and boom raising operation, the diagram corresponding to FIG. 11 according to the first embodiment.

FIG. 12 is a flowchart of a procedure for determining a limiting pilot pressure with respect to arm crowding, arm dumping, and boom lowering, carried out by a controller of a hydraulic excavator according to a second embodiment of the present invention, the flowchart corresponding to FIG. 9 according to the first embodiment. FIG. 13 is a diagram illustrating a relation between the limiting pilot pressure Pr2 calculated by the procedure illustrated in FIG. 12 and a boom raising operation, the diagram corresponding to FIG. 11 according to the first embodiment.

The present embodiment is different from the first embodiment with respect to the procedure performed by the intervention determining section 42*b* for determining a limiting pilot pressure Pr2 for arm crowding, arm dumping, and boom lowering, and specifically with respect to the omission of a procedure for calculating a transition pressure (steps S304 and S305 in FIG. 9). According to the present embodiment, if no boom raising operation is determined in step S303, then the sequence goes to step S306, irrespectively of the non-operation continuation time period Tbm for boom raising. Therefore, under the condition in which the target surface distance H1 is equal to or smaller than Hth, the limiting pilot pressure Pr1 calculated by the limiting pilot pressure calculating section 42*a* at the same as the stopping of the boom raising operation becomes the limiting pilot pressure Pr2. Consequently, under the condition in which the target surface distance H1 is equal to or smaller than Hth, the openings of the solenoid pressure reducing valves V2 through V4 are changed from the maximum opening to an opening depending on the target velocity quickly after the stopping of the boom raising operation. Other details including structural and functional details according to the present embodiment are the same as those according to the first embodiment.

The present embodiment also achieves the basic advantage (1) described in the first embodiment, and is more effective than the first embodiment to reduce the possibility that the work implement may excavate soil beyond the target excavation surface St after the boom raising operation.

Third Embodiment

Figure 14:
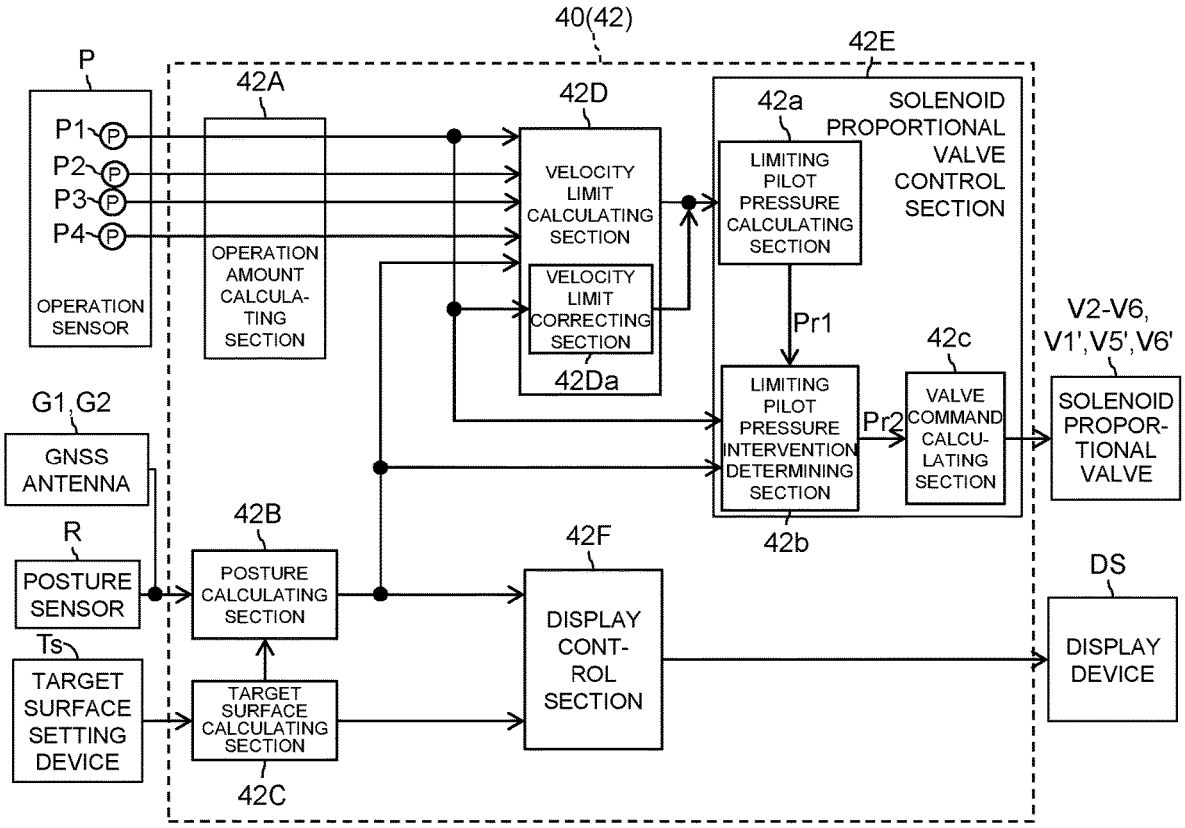
FIG. 14 is a functional block diagram of a controller of a hydraulic excavator according to a third embodiment of the present invention, the diagram corresponding to FIG. 7 according to the first embodiment.

FIG. 14 is a functional block diagram of a controller of a hydraulic excavator according to a third embodiment of the present invention, the diagram corresponding to FIG. 7 according to the first embodiment. The present embodiment is different from the first embodiment in that a velocity limit correcting section 42Da is added as a function of correctively calculating a velocity limit to the velocity limit calculating section 42D. The velocity limit correcting section 42Da corrects velocity limits for arm crowding and arm dumping to be output to the limiting pilot pressure calculating section 42*a* on the basis of the degree of the boom raising operation and the velocity limits for arm crowding and arm dumping. Specifically, for a constant period of time after the boom raising operation has stopped, the velocity limit calculated for arm crowding or arm dumping is corrected in an increasing direction at a corrective increasing ratio based on a time (the non-operation continuation time period Tbm) that has elapsed from the stopping of boom raising operation (as described later).

Figure 15:
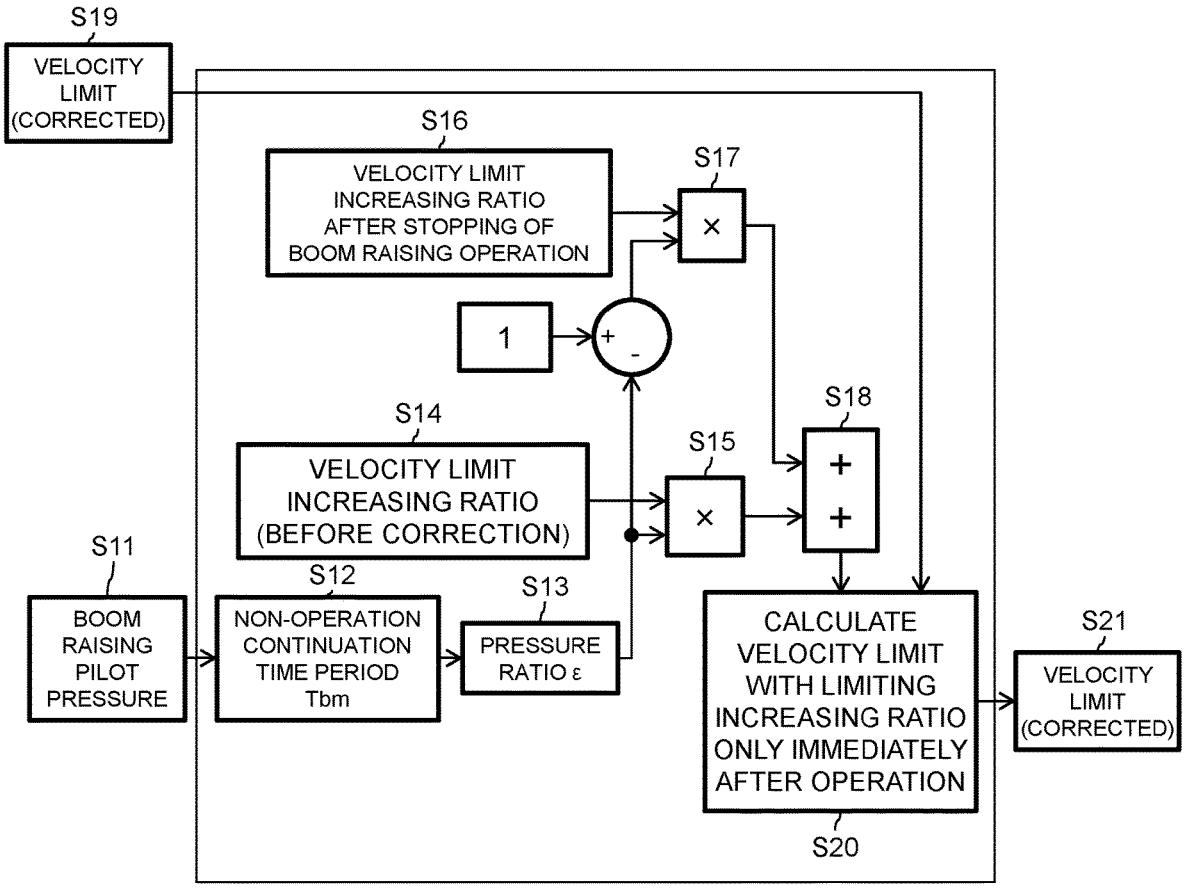
FIG. 15 is a block diagram illustrating a logic for correctively calculating velocity limits for arm crowding and arm dumping, carried out by a velocity limit correcting section illustrated in FIG. 14.

FIG. 15 is a block diagram illustrating a logic for correctively calculating velocity limits for arm crowding and arm dumping, carried out by the velocity limit correcting section 42Da. Velocity limits for arm crowding and arm dumping are appropriately corrected and individually calculated by the calculating logic illustrated in FIG. 15. The logic for calculating a velocity limit for an arm crowding action will be described below as a representative example with reference to FIG. 15. However, the logic for calculating a velocity limit for an arm dumping action is the same as the logic illustrated in FIG. 15.

Figure 16:
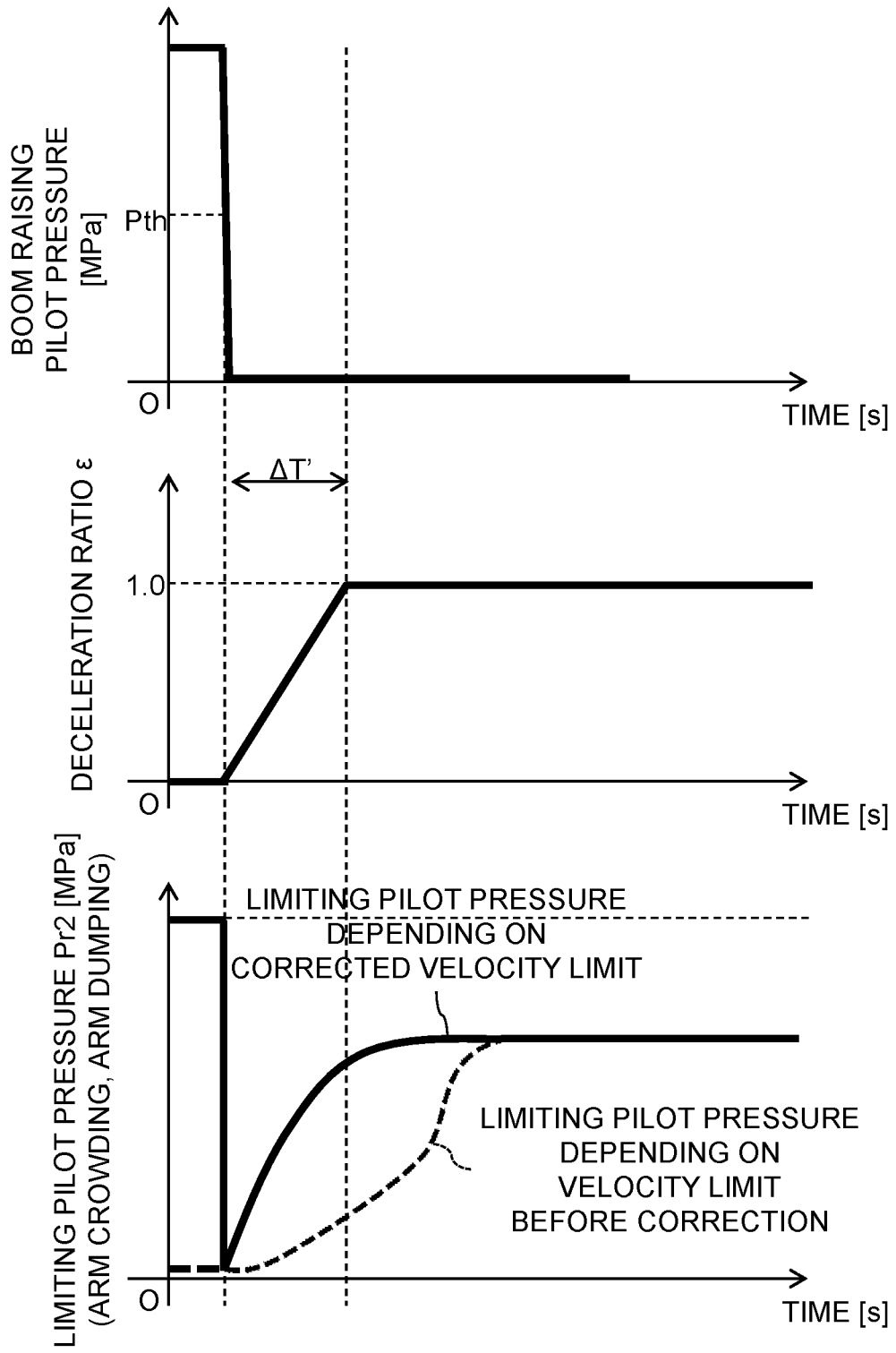
FIG. 16 is a diagram illustrating a relation between a limiting pilot pressure with respect to arm crowding and the like. calculated by the controller of the hydraulic excavator according to the third embodiment of the present invention, and boom raising operation.

For correcting a velocity limit, the boom raising pilot pressure calculated by the operation amount calculating section 42A is input (S11), and a time (the non-operation continuation time period Tbm) that has elapsed from the time when the boom raising pressure has changed from Pth to a value lower than Pth is calculated (S12). The non-operation continuation time period Tbm is reset to zero each time the boom raising pilot pressure becomes equal to or higher than Pth. The calculated non-operation continuation time period Tbm is input to a deceleration ratio table, and a deceleration ratio ε (FIG. 16) is calculated on the basis of the deceleration ratio table (S13). The deceleration ratio ε refers to a proportion of an increasing ratio of the velocity limit to be corrected that has been obtained on the basis of the degree of the arm crowding action and the bucket claw tip position obtained by the posture calculating section 42B, by the velocity limit calculating section 42D with respect to an arm crowing operation, in a corrected increasing ratio to be obtained later. The deceleration ratio table is prescribed to increase (to increase linearly according to the present embodiment) from 0 (minimum) to 1.0 (maximum) while the non-operation continuation time period Tbm for boom raising is changing from zero to a predetermined time period ΔT' set in advance (FIG. 16). The velocity limit correcting section 42Da multiplies the velocity limit increasing ratio to be corrected that has been obtained for an arm crowding action by the velocity limit calculating section 42D (S14) by the deceleration ratio ε calculated on the basis of the deceleration ratio table (S15).

At the same time, a velocity limit increasing ratio (=default value>velocity limit increasing ratio to be corrected) after a boom raising operation with respect to arm crowding is input from the ROM 43, for example, (S16), and is multiplied by a ratio (1-ε) (S17). The value of the velocity limit increasing ratio after the boom raising operation that is multiplied by (1-ε) and the value of the velocity limit increasing ratio to be corrected that is multiplied by ε are added to each other, thereby calculating a corrected increasing ratio (S18).

With respect to a velocity limit calculated for arm crowding (S19), the velocity limit to be corrected for arm crowding only immediately after an arm crowding operation (e.g., for the predetermined time period ΔT' after the stopping of the boom raising operation) is corrected in an increasing direction with the corrected increasing ratio described above (S20). As described above, for a certain period of time after the boom raising operation, the shorter the elapsed time is, the more the velocity limit is corrected to increase because the velocity limit increasing ratio after the boom raising operation that is larger than the velocity limit to be corrected has a strong effect. On the other hand, except immediately after the arm crowding operation (e.g., other than the predetermined time period ΔT' after the stopping of the boom raising operation) the velocity limit for arm crowding is not corrected. The velocity limit that is thus corrected to increase as required by the velocity limit correcting section 42Da in the velocity limit calculating section 42D is output to the limiting pilot pressure calculating section 42*a* (S21), and converted into a limiting pilot pressure Pr1 by the limiting pilot pressure calculating section 42*a*.

FIG. 16 is a diagram illustrating a relation between a limiting pilot pressure with respect to arm crowding and the like. calculated by the controller (the intervention determining section 42*b*) of the hydraulic excavator according to the present third embodiment, and the boom raising operation. FIG. 16 illustrates by way of example the calculation by the intervention determining section 42*b* of a limiting pilot pressure in the mode illustrated in FIG. 13 (the second embodiment). The method of calculating a velocity limit according to the present embodiment is also applicable to the first embodiment.

As illustrated in FIG. 16, for a certain period of time after the stopping of the boom raising operation, a limiting pilot pressure Pr2 is calculated to be of a larger value than if a velocity limit is not corrected, and the openings of the solenoid pressure reducing valves V3 and V6 are also increased. According to the first and second embodiments, the openings of the solenoid pressure reducing valves are increased by increasing an apparent limiting pilot pressure under certain conditions. According to the present embodiment, the openings of the solenoid pressure reducing valves can be increased by increasing an apparent velocity limit. Combining velocity limit corrections results in more variations of modes for controlling the limiting pilot pressure Pr2, contributing to the realization of more flexible operation.

Modifications

According to the first and second embodiments, arm crowding, arm dumping, and boom lowering are illustrated by way of example as targets for switching control of the limiting pilot pressure Pr2. However, if only arm crowding and arm dumping are targets for improving response delays, then boom lowering may be dropped from the targets for switching control of the limiting pilot pressure Pr2. Conversely, if response delays with respect to bucket dumping and bucket crowding need to be improved, they can also be included as targets. Also with respect to bucket crowding and bucket dumping, a limiting pilot pressure may be calculated, and the degree to which solenoid pressure reducing valves are actuated may be controlled in the same manner as with arm crowding and the like. In this case, the parameters δ, ε, Tth, Pth, and Hth may be shared by or may be set to individual values for arm crowding, arm dumping, boom lowering, bucket crowding, and bucket dumping. Note that, though the solenoid pressure reducing valve V1' for forced boom raising has not been described in particular, it can be controlled in the same manner as with the solenoid pressure reducing valve V3 and the like. The solenoid of the solenoid pressure reducing valve V1' can be de-energized (opening 0) when MC is canceled or semi-canceled (e.g., before Tth in FIG. 11), for example.

DESCRIPTION OF REFERENCE CHARACTERS

1: Hydraulic excavator
1A: Work implement
2: Hydraulic pump
5: Boom cylinder (hydraulic actuator)
6: Arm cylinder (hydraulic actuator)
7: Bucket cylinder (hydraulic actuator)
8: Boom
9: Arm
10: Bucket
15: Control valve unit
40: Controller
42*b*: Limiting pilot pressure intervention determining section
42D: Velocity limit calculating section
160: Solenoid valve unit
A1 to A6: Control lever device
R1 to R3: Angle sensor (posture sensor)
R4: Vehicle body tilt angle sensor (posture sensor)
St: Target excavation surface
Tth: Predetermined time period
V2 to V6, V1', V5', V6': Solenoid pressure reducing valve
ΔT': Predetermined time period

The invention claimed is:

1. A hydraulic excavator comprising:

a multi-joint work implement including a boom and an arm;

a plurality of hydraulic actuators that actuate the work implement, the hydraulic actuators including a boom cylinder for actuating the boom;

a plurality of posture sensors that detect a posture of the work implement;

a hydraulic pump that discharges a hydraulic fluid actuating the plurality of hydraulic actuators;

a control valve unit that controls a flow of the hydraulic fluid supplied from the hydraulic pump to the plurality of hydraulic actuators;

a plurality of control lever devices that output a pilot pressure actuating the control valve unit, with use of a discharged pressure from a pilot pump as a source pressure;

a solenoid valve unit including a plurality of solenoid pressure reducing valves connected between the plurality of control lever devices and the control valve unit; and a controller including a machine control function to calculate velocity limits for the plurality of hydraulic actuators on a basis of signals from the plurality of posture sensors and control openings of the solenoid pressure reducing valves to prevent the work implement from excavating soil beyond a target excavation surface on a basis of the velocity limits, wherein the controller is configured to control the solenoid pressure reducing valves to ease the velocity limits of arm crowding and arm dumping actions while a boom raising operation signal is being output from the control lever devices, while the machine control function is being performed.

2. The hydraulic excavator according to claim 1, wherein the controller is configured to control the opening of the solenoid pressure reducing valve that corresponds to a boom lowering action to be larger than the opening based on the velocity limits when the controller is configured to control the openings of the solenoid pressure reducing valves that correspond to the arm crowding and arm dumping actions to be larger than the opening based on the velocity limits.

3. The hydraulic excavator according to claim 1, wherein the controller is configured to control the solenoid pressure reducing valves that correspond to the arm crowding and arm dumping actions to increase their openings while the boom raising operation signal is being output from the control lever devices.

4. The hydraulic excavator according to claim 3, wherein the controller is configured to control the openings of the solenoid pressure reducing valves that correspond to the arm crowding and arm dumping actions to decrease monotonously after stopping of the boom raising operation, and to return to the opening based on the velocity limits in a predetermined time after the stopping of boom raising operation.

* * * * *